US008897672B2

(12) United States Patent
Takagi

(10) Patent No.: US 8,897,672 B2
(45) Date of Patent: Nov. 25, 2014

(54) IMAGE FORMING APPARATUS CAPABLE OF SUPPRESSING BELT WALK

(75) Inventor: Hiroaki Takagi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 217 days.

(21) Appl. No.: 13/605,655

(22) Filed: Sep. 6, 2012

(65) Prior Publication Data

US 2013/0071150 A1 Mar. 21, 2013

(30) Foreign Application Priority Data

Sep. 16, 2011 (JP) ..... 2011-203006

(51) Int. Cl.
*G03G 15/01* (2006.01)
*G03G 15/16* (2006.01)

(52) U.S. Cl.
CPC .. *G03G 15/0189* (2013.01); *G03G 2215/00156* (2013.01)
USPC ..... 399/121; 399/299; 399/302

(58) Field of Classification Search
CPC ..... G03G 15/755; G03G 15/1605; G03G 15/1615; G03G 2215/00143
USPC ..... 399/82, 121, 165, 298, 299, 301–303
See application file for complete search history.

(56) References Cited

U.S. PATENT DOCUMENTS

| | | | | |
|---|---|---|---|---|
| 8,112,021 | B2 * | 2/2012 | Mochizuki | 399/302 |
| 8,238,793 | B2 * | 8/2012 | Nakura et al. | 399/165 |
| 8,406,665 | B2 * | 3/2013 | Hirose et al. | 399/302 |
| 2010/0232819 | A1 | 9/2010 | Kudo et al. | |
| 2011/0110691 | A1 | 5/2011 | Hirose et al. | |
| 2012/0190489 | A1 | 7/2012 | Takagi | |

FOREIGN PATENT DOCUMENTS

| | | |
|---|---|---|
| JP | 2009-063909 | 3/2009 |
| JP | 2012-063631 | 3/2012 |

* cited by examiner

*Primary Examiner* — William J Royer
(74) *Attorney, Agent, or Firm* — Harness, Dickey & Pierce, P.L.C.

(57) ABSTRACT

An image forming apparatus includes a belt stretched and wound around a driving roller and multiple driven rollers; multiple image formation units arranged in a running direction of the belt including photoconductors to form toner images of different colors; multiple transfer rollers opposed to the photoconductors via the belt; an engagement/disengagement device to bring at least one of the multiple transfer rollers in contact with and separate from the belt in accordance with an image formation mode; a steering controller to correct displacement of the belt in a widthwise direction by inclining one of the multiple driven rollers in a prescribed direction as a steering roller not to change a perimeter of the belt at least in a first image formation mode in which all of the multiple transfer rollers contact the belt; at least one position adjustment roller; and a belt position adjuster.

20 Claims, 23 Drawing Sheets

IMAGE FORMING APPARATUS CAPABLE OF SUPPRESSING BELT WALK

CROSS-REFERENCE TO RELATED APPLICATION

This patent application is based on and claims priority pursuant to 35 U.S.C. §119 to Japanese Patent Application No. 2011-203006, filed on Sep. 16, 2011 in the Japanese Patent Office, the entire disclosure of which are hereby incorporated by reference herein.

BACKGROUND OF THE INVENTION

1. Field of the Invention

The present invention relates to an image forming apparatus, such as a color copier, a color printer, a color multifunctional device, and the like, employing an intermediate transfer system or a direct transfer system including a mechanism to switch between monochromatic and multicolor modes.

2. Description of the Background Art

There exists a color image forming apparatus, such as a copier, a printer, an image forming apparatus, and the like, for forming a multi-color (i.e., color) image using a circulating belt, such as an intermediate transfer belt, a photoconductor belt, a sheet transfer belt, and the like. As this type of a color image forming apparatus, there is a tandem color image forming apparatus, for example, separately incorporating image formation units forming toner images of yellow, magenta, cyan, black, and a special color, such as gloss, and the like, respectively, on a belt, such as an intermediate transfer belt, and the like., stretched around multiple rollers.

The tandem color image forming apparatus forms the different color toner images on photoconductors in the respective image formation units, and sequentially transfers and superimposes those onto an intermediate transfer belt or a recording medium (i.e., sheet) transported by the sheet transfer belt. When the tandem color image forming apparatus employs an intermediate transfer system, a toner image on the intermediate transfer belt is secondarily transferred onto a recording medium, such as a sheet, and the like. In either situation, the recording medium, onto which the toner image is ultimately transferred, passes through a fixing device that fixes the image on the recording medium. Then, the recording medium is discharged from the apparatus.

In general, such an image forming apparatus is configured to switch between a multicolor mode to form a color image and a monochromatic mode to form a monochromatic image (generally a grayscale image). Accordingly, a prescribed mechanism is provided to reposition the belt such that the belt engages all photoconductors in the multiple image formation units in the multicolor mode, and only engages one of the photoconductors of the multiple image formation units in the monochromatic mode.

Generally, in a belt driving system in which a circulating belt is supported by multiple rollers and is circulated by one of the multiple rollers serving as a driving roller, belt displacement of the circulating belt (so-called belt walk) in a lateral, widthwise direction (i.e., a direction perpendicular to a belt running direction) may occur. In the above-described tandem color image forming apparatus, belt walk induces relative displacement of each color image when the color images are transferred and superimposed, e.g., on the intermediate transfer belt, thereby causing color displacement or color unevenness, and the like. Therefore, to obtain output of high-quality images, belt walk needs to be appropriately corrected.

It is known that when a position of a roller stretching the belt is changed, a displacement speed varies accordingly and takes a certain amount of time until it is stabilized. Therefore, when switching between the monochromatic mode and the full-color mode and thus repositioning the belt, such as an intermediate transfer belt, and the like, the belt walk speed varies. As a result, a transfer position of each color-toner image deviates in the main scanning direction (i.e., a direction orthogonal to the belt, or the belt widthwise direction) due to belt walk when a prescribed mode is switched to a full-color mode, and accordingly, an abnormal image with color displacement is formed.

Several techniques have been proposed to correct belt walk. For example, a belt walk control system (hereinafter, simply referred to as a steering system) is known in which one of the multiple rollers supporting a circulating belt serves as a correction roller (hereinafter, simply referred to as a steering roller) and is slightly inclined in a direction not to change a perimeter of the belt so as to control the displacement thereof. There is also a system (hereinafter, simply referred to as a displacement stopping system) that forcibly minimizes the belt walk with a rib or a guide or the like. The above-described steering system is generally more reliable than the displacement stopping system because a force applied to the belt is weaker.

However, a displacement speed varies also in the steering system for a certain amount of time when a primary transfer roller initially either contacts or separates from the belt, and consequently a color displacement may occur when a multicolor image is outputted during that time period. Further, when image formation modes are switched in the steering system, a steep change occurs in displacement direction. Furthermore, the stability of the steering roller varies with the positioning of the belt.

For this reason, to avoid such color displacement and an abnormal image caused by the belt walk in the main scanning direction when switching from a monochromatic mode to a full-color mode in an image forming apparatus, a displacement amount of the belt, such as intermediate transfer belt, and the like, in a widthwise direction is detected and color image formation is not executed until a detected value falls below a prescribed threshold level, as described in Japanese Patent Application Publication No. 2009-63909 (JP-2009-63909-A), for example.

However, allowing time for the belt to stabilize after switching from the monochromatic mode to the full-color mode in this way degrades, productivity, i.e., the efficiency of image formation that is especially highly valued in the market.

BRIEF SUMMARY OF THE INVENTION

Accordingly, the present invention provides a novel image forming apparatus operable in multiple image formation modes and comprises a belt stretched and wound around a driving roller and multiple driven rollers, multiple image formation units arranged in a running direction of the belt including photoconductors to form toner images of different colors on the photoconductors, respectively, and multiple transfer rollers opposed to the photoconductors via the belt, respectively. The toner images on the photoconductors are transferred onto either the belt or a recording medium transported by the belt one after another by the multiple transfer rollers, respectively. An engagement/disengagement device is provided to bring one or more multiple transfer rollers in contact with the belt and separate one or more multiple transfer rollers therefrom in accordance with an image formation mode when the multiple image formation modes are switched. A steering controller is provided to correct displacement of the belt in its widthwise direction by inclining one or more multiple driven rollers in a prescribed direction as a steering roller not to change a perimeter of the belt in a first image formation mode in which all of the multiple transfer rollers contact the belt. One or more position adjustment rollers is provided to extend in a widthwise direction of the belt on the same side as the multiple transfer rollers at a region where a stretching posture of the belt varies when the multiple image formation modes are switched. The position adjustment roller contacts the belt at a first given winding angle in a second image formation mode in which the multiple transfer rollers partially separate from the belt. A belt position adjuster is provided to adjust a position of the belt in its widthwise direction by inclining one or more position adjustment rollers in a prescribed direction not change the perimeter of the belt in the second image formation mode.

In another aspect of the present invention, a storage unit is provided to store a stabilizing inclination of the steering roller stabilizing the intermediate transfer belt at a prescribed position in its widthwise direction under control of the steering controller in the first image formation mode. The steering controller controls the position of the belt in its widthwise direction targeting the stabilizing inclination of the steering roller in the second image formation mode. The belt position adjuster adjusts the position of the belt in its widthwise direction by controlling one or more position adjustment rollers in the second image formation mode.

In yet another aspect of the present invention, when the second image formation mode is switched to the first image formation mode, and a difference between the stabilizing inclination of the steering roller stored in the storage unit and inclination of the steering roller defined right before switching of the image formation modes is less than a given value or equal to or less than the given value, image formation is immediately started in the first image formation mode, and when the difference is not less than the given value nor equal to or less than the given value, image formation in the first image formation mode is started only when the position of the belt is stabilized in its widthwise direction by the steering controller or both the steering controller and the belt position adjuster.

In yet another aspect of the present invention, the steering controller fixes a target inclination of the steering roller to either an inclination defined immediately before switching of the image formation modes or the stabilizing inclination of the steering roller stored in the storage unit when the first image formation mode is switched to the second image formation mode.

In yet another aspect of the present invention, the position adjustment roller contacts the belt either at a second given winding angle smaller than the first given winding angle or no winding angle in the second image formation mode.

In yet another aspect of the present invention, the position adjustment roller separates from the belt in the second image formation mode.

In yet another aspect of the present invention, the multiple image formation modes include a third image formation mode in which the less number of the multiple transfer rollers separates from the belt than in the second image formation mode, and a pair of position-adjustment rollers are disposed and entirely or partially utilized corresponding to the image formation mode switched.

In yet another aspect of the present invention, one of the pair of position adjustment rollers only contacts the belt in one of the second and third image formation modes at the first given winding angle, and the other one of the pair of position adjustment rollers contacts the belt in both of the second and third image formation modes at the first given winding angle.

In yet another aspect of the present invention, the multiple image formation units include a black image formation unit to form a black toner image, and three or more image formation units including three or more photoconductors to form three or more different toner images of yellow, magenta, and cyan colors, respectively. The multiple transfer rollers include a black transfer roller opposed to the photoconductor included in the black image formation unit via the belt and three or more transfer rollers opposed to three or more photoconductors via the belt, respectively. The first image formation mode is an all-color mode utilizing all of the multiple image formation units, and the second image formation mode is a monochromatic mode only using the black image formation unit. All of the multiple transfer rollers contact the belt in the all-color mode, and three or more transfer rollers separate from the belt while the position adjustment roller contacts the belt at the first given winding angle in the monochromatic mode.

In yet another aspect of the present invention, the multiple image formation units form toner images of different colors on respective photoconductors and include a black image formation unit to form a black toner image, three or more image formation units including three or more photoconductors to form three or more toner images of yellow, magenta, and cyan colors, respectively, and a special color image formation unit to form a toner image of a special color. The multiple transfer rollers include a black transfer roller opposed to the photoconductor included in the black image formation unit via the belt, three or more transfer rollers opposed to the three or more photoconductors via the belt, respectively, and a special color transfer roller opposed to the photoconductor included in the special color image formation unit via the belt. The first image formation mode is an all-color mode utilizing all of the multiple image formation units including the special color image formation unit, the second image formation mode is a monochromatic image formation mode only using the black image formation unit, and the third image formation mode is a four color mode utilizing the black and three or more color image formation units. All of the multiple transfer rollers contact the belt in the all-color mode, only the special color transfer roller separates from the belt while only one of the pair of position adjustment roller contacts the belt at the first given winding angle in the four color mode, and the three or more different color transfer rollers and the special color transfer roller separate from the belt while both of the position adjustment rollers contact the belt at the first given winding angle in the monochromatic mode.

A method of forming an image in multiple image formation modes comprises the steps of stretching and winding a belt around a driving roller and multiple driven rollers, arranging multiple image formation units including photoconductors to form toner images of different colors on the photoconductors, respectively, in a running direction of the belt, and arranging multiple transfer rollers facing corresponding one of the photoconductors via the belt, respectively, the toner images on the photoconductors being successively transferred onto either the belt or a recording medium transported by the belt by the multiple transfer rollers, respectively. Further, the steps of bringing at least one of the multiple transfer rollers with an engagement/disengagement device in contact with the belt and separating the at least one of the multiple transfer rollers therefrom in accordance with an image formation mode when the multiple image formation modes are switched, arranging at least one position adjustment roller in the widthwise direction of the belt on the same side as the multiple transfer rollers at a region where a stretching posture of the belt varies when the multiple image formation modes are switched; bringing the position adjustment roller in contact with the belt at a first given winding angle in a second image formation mode in which one of the multiple transfer rollers separates from the belt are included. Furthermore, the steps of correcting displacement of the belt in its widthwise direction under control of a steering controller by inclining one of the multiple driven rollers in a prescribed direction as a steering roller not to change a perimeter of the belt at least in a first image formation mode in which all of the multiple transfer rollers contact the belt, and adjusting a position of the belt in the widthwise direction with a belt position adjuster by inclining the at least one position adjustment roller in a prescribed direction not to change the perimeter of the belt in the second image formation mode are included.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
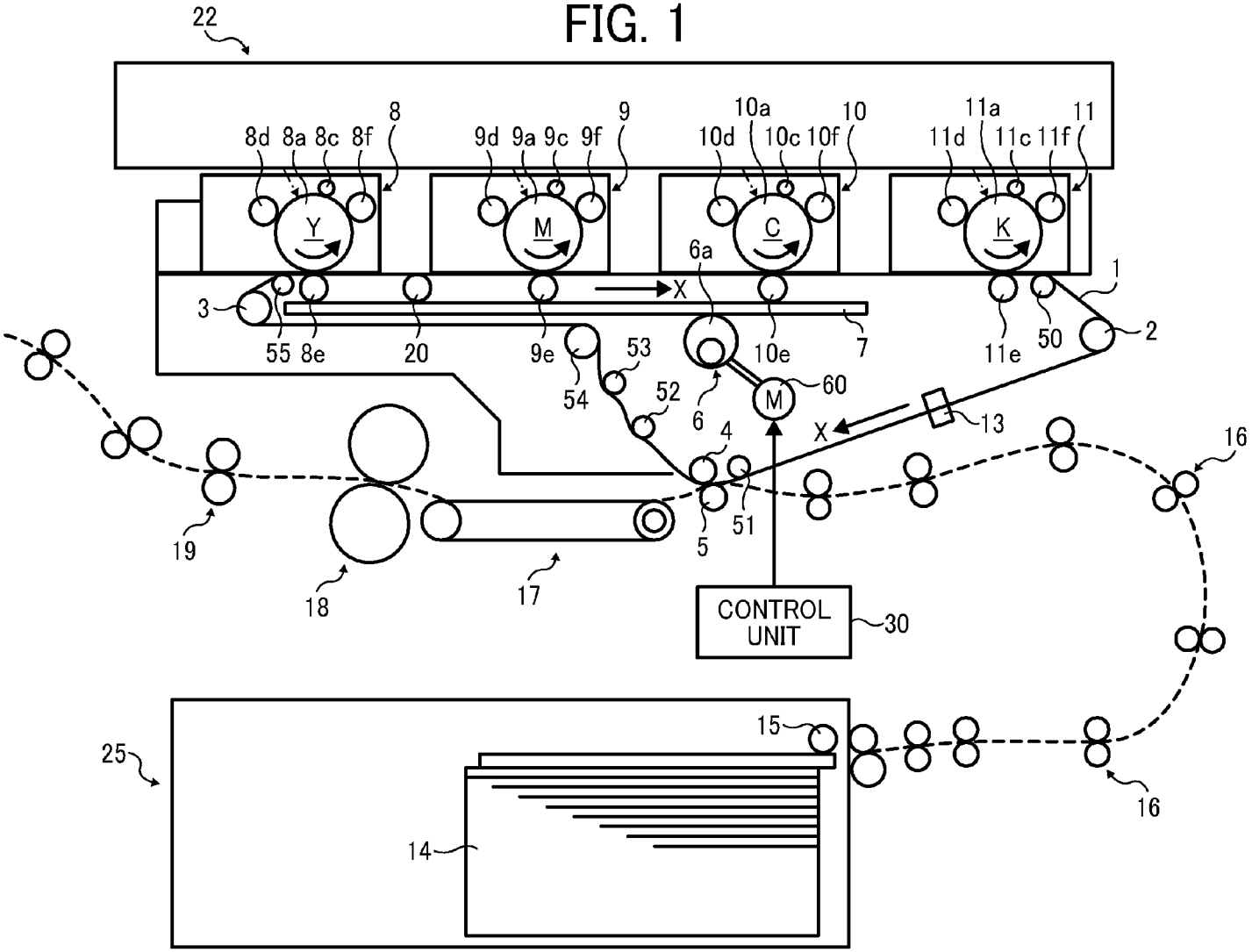
FIG. 1 is a schematic diagram illustrating an interior configuration of an image forming apparatus of one embodiment of the present invention.

Referring now to the drawings, wherein like reference numerals designate identical or corresponding parts throughout the several views thereof and in particular to FIG. 1, an exemplary interior configuration of an image forming apparatus according to a first embodiment of the present invention is described. In this image forming apparatus, an intermediate transfer belt 1 as a circulating belt is stretched around a driving roller 2, a driven roller 3, a secondary transfer opposed roller 4, and multiple driven rollers 50 to 55 generating a certain amount of tension.

Further, multiple image formation units 8, 9, 10, and 11 are sequentially disposed above the intermediate transfer belt 1 in a belt running direction (i.e., a direction X shown by an arrow) corresponding to respective yellow (Y), magenta (M), cyan (C), and black (K) colors. However, an order of the Y, M, and C colors can be optional. The black image formation unit 11 is located on the most downstream side in a running direction of the intermediate transfer belt 1 (i.e., on a side close to the driving roller 2).

The image formation units 8, 9, 10, and 11 have photoconductive drums 8*a*, 9*a*, 10*a*, and 11*a* as photoconductors supported by a frame of an apparatus main body to freely rotate. Respective chargers 8*c*, 9*c*, 10*c*, and 11*c*, developing units 8*d*, 9*d*, 10*d*, and 11*d*, and cleaners 8*f*, 9*f*, 10*f*, and 11*f* are disposed one by one in a drum rotation direction (i.e., in a counterclockwise direction in the drawing) around the photoconductive drums 8*a*, 9*a*, 10*a*, and 11*a*.

Above the image formation units 8, 9, 10, and 11, an image writing unit 22 is provided to expose and scan the surfaces of the photoconductive drums 8*a*, 9*a*, 10*a*, and 11*a* with a laser beam. At respective positions facing the image formation units 8, 9, 10, and 11 across the intermediate transfer belt 1, transfer rollers 8*e*, 9*e*, 10*e*, and 11*e* are located as primary transfer rollers.

Among the primary transfer rollers 8*e*, 9*e*, 10*e*, and 11*e*, the three primary transfer rollers 8*e*, 9*e*, and 10*e* used in transferring color images located upstream in the running direction of the intermediate transfer belt 1 are held by a color bracket 7, and distances to the respective photoconductive drums 8*a*, 9*a*, and 10*a* are changed by an engagement/disengagement mechanism 6, such as an eccentric cam 6*a*, and the like, and an engagement/disengagement driving motor 60. Thus, the color bracket 7, the engagement/disengagement mechanism 6, and the engagement/disengagement-driving motor 60 collectively constitute an engagement/disengagement device. Here, the engagement/disengagement mechanism means that contacting and separated states are switched.

The engagement/disengagement driving motor 60 is controlled by a control unit 30 that generally controls the image forming apparatus. An elastic force is downwardly applied to the color bracket 7 by a spring or the like, not shown. The color bracket 7 rises when the eccentric cam 6*a* of the engagement/disengagement mechanism 6 is rotated by the engagement/disengagement driving motor 60 to a position as shown in the drawing. The color bracket 7 causes the primary transfer rollers 8*e*, 9*e*, and 10*e* to contact the intermediate transfer belt 1 as illustrated in the drawing and further moves the primary transfer rollers 8*e*, 9*e*, and 10*e* to approach the respective photoconductive drums 8*a*, 9*a*, and 10*a*.

The primary transfer roller 11*e* used in transferring a monochromatic (i.e., black) image is not held by the color bracket 7, and thus a distance to the photoconductive drum 11*a* does not vary. Further, between the primary transfer rollers 8*e* and 9*e*, a position adjustment roller 20 is provided to touch a lower surface of the intermediate transfer belt 1, a function of which is described later more in detail.

The image forming apparatus can switch an all-color mode (i.e., a full-color mode) to form a full-color image and a monochromatic mode (i.e., a black and white mode) to form a monochromatic image vice versa. In the all-color mode, the primary transfer rollers 8*e*, 9*e*, 10*e*, and 11*e* all take positions contacting the intermediate transfer belt 1, while facing the respective photoconductive drums 8*a*, 9*a*, 10*a*, and 11*a* in the image formation units 8, 9, 10, and 11 across the intermediate transfer belt 1.

In the monochromatic mode, the primary transfer rollers 8*e*, 9*e*, and 10*e* are moved by the above-described engagement/disengagement device to positions away from the intermediate transfer belt 1 and the photoconductive drums 8*a*, 9*a*, and 10*a*, while only the primary transfer roller 11*e* used in transferring a black image contacts the intermediate transfer belt 1 facing the black photoconductive drum 11*a* across the intermediate transfer belt 1.

Further, a sheet 14 as a recording medium serving as an image formation target is contained in a sheet feed cassette 25, and is launched by a pickup roller 15 disposed on a sheet launching side of the sheet feed cassette 25 one by one. The thus extruded sheet 14 is transported by multiple pair of transfer rollers 16 along a track shown by a dashed line in FIG. 1. The sheet 14 is further sent to a secondary transfer position in which a secondary transfer roller 5 is opposed to the secondary transfer opposed roller 4 across the intermediate transfer belt 1. On a downstream side of the secondary transfer position in a sheet transport direction, a transfer sheet conveyance device 17, a fixing device 18, and a pair of sheet ejection conveying rollers 19 are disposed.

Now, an outline process forming a color image in an all-color mode using the thus constructed image forming apparatus is described with reference to FIG. 1. First, an image formation process is started in order in each of the image formation units 8, 9, 10, and 11. Specifically, a surface of each of the photoconductive drums 8*a*, 9*a*, 10*a*, and 11*a* is uniformly charged by each of chargers 8*c*, 9*c*, 10*c*, and 11*c*. Each surface is then subjected to exposure of optical scanning executed by the image writing unit 22 in accordance with an image per color, so that electrostatic latent images are formed thereon. The electrostatic latent images are then developed by color toner particles stored in the respective developing unit 8*d*, 9*d*, 10*d*, and 11*d*, so that toner images of yellow, magenta, cyan, and black are sequentially formed.

The toner image on each of the photoconductive drum 8*a*, 9*a*, 10*a*, and 11*a* is sequentially and primarily transferred and superimposed on the intermediate transfer belt 1 by an action of each of the primary transfer rollers 8*e*, 9*e*, 10*e*, and 11*e* to which a prescribed bias voltage is applied. Accordingly, a full-color image composed of yellow, magenta, cyan, and black colors is formed on the intermediate transfer belt 1.

Subsequently, the full-color image is sent to a secondary transfer position as the intermediate transfer belt 1 travels. The color image is then transferred onto the sheet 14 as a recording medium transferred thereto at a given time by the action of the secondary transfer roller 5, to which a bias voltage is applied (i.e., a secondary transfer process). The sheet 14 with the transferred color image is further transported to the fixing device 18 by the transfer sheet conveyance device 17. The sheet 14 with the transferred color image is then subjected to a fixing process of heating under pressure and is then ejected onto a sheet output tray, not shown, by multiple pair of sheet ejection conveying rollers 19.

The recording medium can employ every medium if it allows a toner image transferred thereon. The recording medium is generally called a transfer sheet, a printing sheet, a recording sheet, and a printing sheet or the like in addition to the sheet. When displacement of the intermediate transfer belt 1 occurs in a widthwise direction thereof in such a series of image forming operations, relative displacement occurs at a position of a toner image transferred on the intermediate transfer belt 1 by each of the image formation units 8, 9, 10, and 11.

Therefore, the image forming apparatus executes controlling to avoid displacement of the intermediate transfer belt 1 in its widthwise direction using a steering system. Therefore, the driven roller 3 furthest from the driving roller 2 among the multiple rollers stretching the intermediate transfer belt 1 therearound is used as a steering roller (hereinafter called a "steering roller 3") to function as a belt walk correction roller. Specifically, to correct the belt walk, the driven roller 3 is controlled and is driven being slightly inclined in a direction not to change a perimeter of the intermediate transfer belt 1.

In this embodiment, to correct displacement of the intermediate transfer belt 1 using a steering system in this way, a belt edge sensor 13 is provided to detect a position of a side end (edge) of the intermediate transfer belt 1 in a widthwise direction. A known mechanism is also incorporated to incline the steering roller 3. The belt edge sensor 13 is placed on a driving route of the intermediate transfer belt 1 and detects the position of side edge (edge) of the intermediate transfer belt 1. The belt edge sensor 13 is located downstream from the steering roller 3 and upstream to the secondary transfer roller 5 in the belt running direction (i.e., a direction shown by arrow X). In this embodiment, the belt edge sensor 13 is located between the driving roller 2 and the secondary transfer opposed roller 4.

Figure 2:
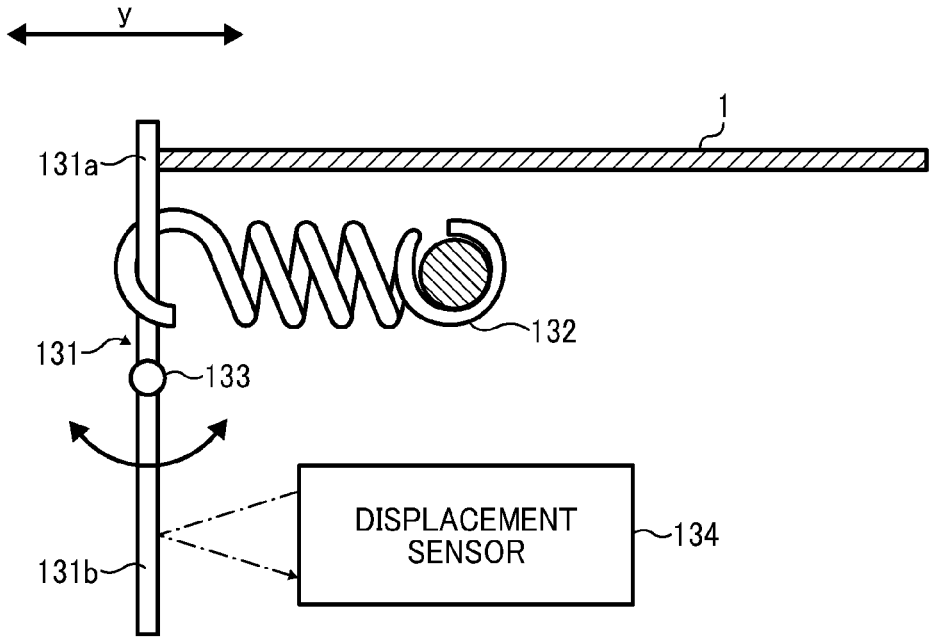
FIG. 2 is a schematic diagram illustrating a specific configuration of a belt edge sensor 13 shown in FIG. 1.

Now, one example of the belt edge sensor 13 is described with reference to FIG. 2. As shown in FIG. 2, one side end 131*a* of a contactor 131 is biased by pulling power of a spring 132, thereby contacting one side edge of the intermediate transfer belt 1 in the widthwise direction of the intermediate transfer belt 1.

In this situation, an intensity of pressure of the contactor 131 caused by the spring 132 is appropriately determined not to transform the intermediate transfer belt 1. Further, the contactor 131 is supported by an axis 133 at a middle part thereof to freely swing therearound. A displacement sensor 134 is provided facing the other side end 131*b* of the contactor 131 extending on the opposite side of the one side end 131*a* regarding the axis 133.

In the belt edge sensor 13, a motion of the intermediate transfer belt 1 in its widthwise direction (i.e., a direction y in the drawing) caused when the displacement occurs is converted to a swinging motion of the contactor 131 contacting the one side edge of the intermediate transfer belt 1 (i.e., a belt edge). Because a distance between the displacement sensor 134 and the other side end 131*b* of the contactor 131 varies in accordance with an amount of displacement of the other side end 131*b* caused by swinging of the contactor 131, an output level of the displacement sensor 134 as a reflective photosensor fluctuates. Thus, a positional variation of the belt edge can be detected based on the output level of the displacement sensor 134.

Figure 3:
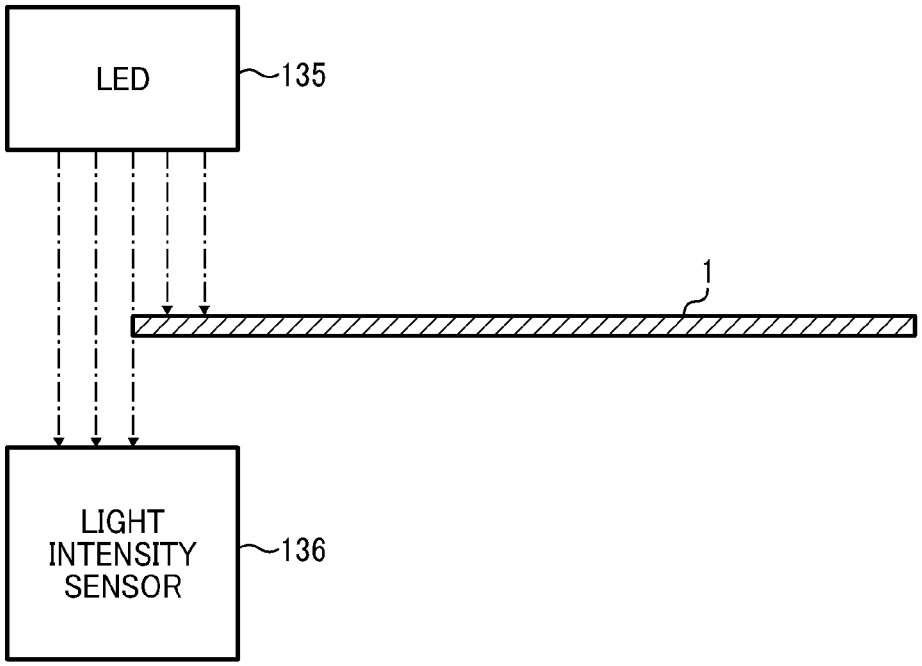
FIG. 3 is a schematic diagram illustrating another configuration of a belt edge sensor 13 shown in FIG. 1.

The belt edge sensor 13 can employ every configuration if it generates an output according to a change in position of the intermediate transfer belt 1 caused by belt walk in its widthwise direction. For example, a light-emitting diode (LED) 135 and a light intensity sensor 136 may be arranged facing each other through one side edge (edge) of the intermediate transfer belt 1 in its widthwise direction as shown in FIG. 3. In this situation, intensity of the light emitted from the LED135 and enters the light intensity sensor 136 varies in accordance with a position of one side edge of the intermediate transfer belt 1 in the widthwise direction, and an output level from the light intensity sensor 136 varies in accordance with the intensity of the light.

Now, displacement control using a steering system is described. As shown in FIG. 1, by circulating the intermediate transfer belt 1 in a direction shown by arrow X, one end of an axis of the steering roller 3 extending in a direction perpendicular to a sheet of the drawing is moved up and down (i.e., vertically) using a moving mechanism, such as a lever, a cam, and the like, driven by a stepping motor as a steering motor according to one embodiment. Specifically, displacement of the intermediate transfer belt 1 in its widthwise direction is corrected by slightly inclining the steering roller 3 in a direction not to change a perimeter of the intermediate transfer belt 1, so that the edge position, i.e., the belt position, detected by the belt edge sensor 13 is controlled to coincide with a reference position.

Figure 4:
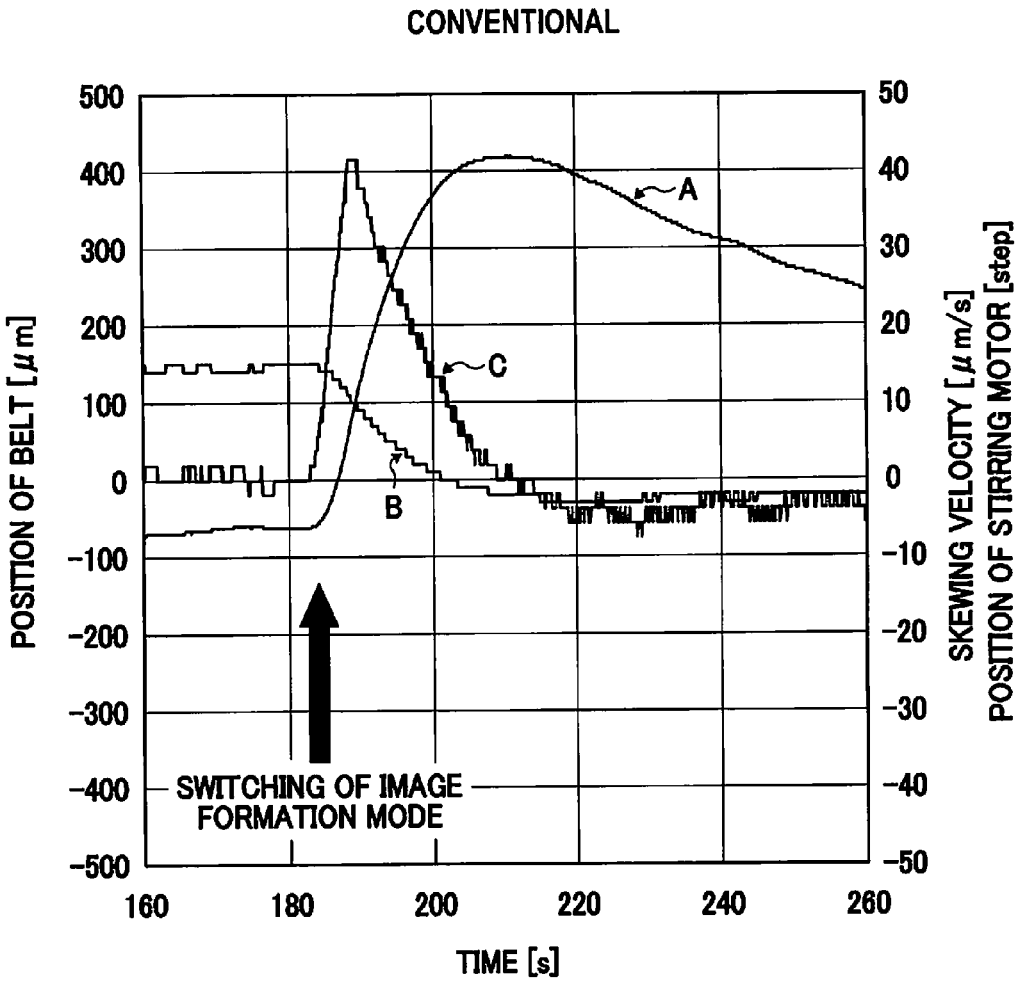
FIG. 4 is a graph illustrating a variation relation between a displacement speed of a belt before and after image formation modes are switched, a position of the belt, and a position of a steering motor as time elapses when belt walk control is executed by a conventional steering system.

FIG. 4 shows a diagram illustrating a conventional relation between temporal variations in displacement speed, and positions of belt and steering motor when displacement control is executed by a conventional steering system. The belt position [μm] is a position of one side edge (i.e., an edge position) of the intermediate transfer belt 1 in the widthwise direction detected by the belt edge sensor 13. When a numerical number zero (0) is assigned to a reference position not displaced, the belt position [μm] is a value indicating a positive or negative offset amount from the reference position in a unit of μm corresponding to a deviation direction as shown in a curve A.

Since the stepping motor is used as the steering motor that drives and inclines the steering roller 3, a rotational position of the stepping motor corresponds to an amount of inclination of the steering roller 3. The position of the steering motor is represented by the positive or negative number of steps corresponding to a rotation direction as shown by a curve B. The displacement speed represents a displacement speed of the intermediate transfer belt 1 in its widthwise direction, and has positive or negative values in a unit of μm/s corresponding to a displacement direction as indicated by the curve C. The horizontal axis suggests elapsing time per 20 seconds.

As can be seen from FIG. 4, although a displacement of the intermediate transfer belt 1 is controlled by the steering system, a belt position (the curve A) greatly varies immediately after image formation modes are switched, and a displacement speed (the curve C) also rapidly temporarily increases so that it takes a certain time period until a variation in belt position is stabilized almost at the reference position. Therefore, it is difficult to sufficiently control the rapid variation in belt position caused by switching of the image formation mode simply by executing such displacement control of the conventional steering system. Further, an abnormal image, such as color displacement, and the like, occurs when it is formed during the rapid variation in belt position.

Figure 5:
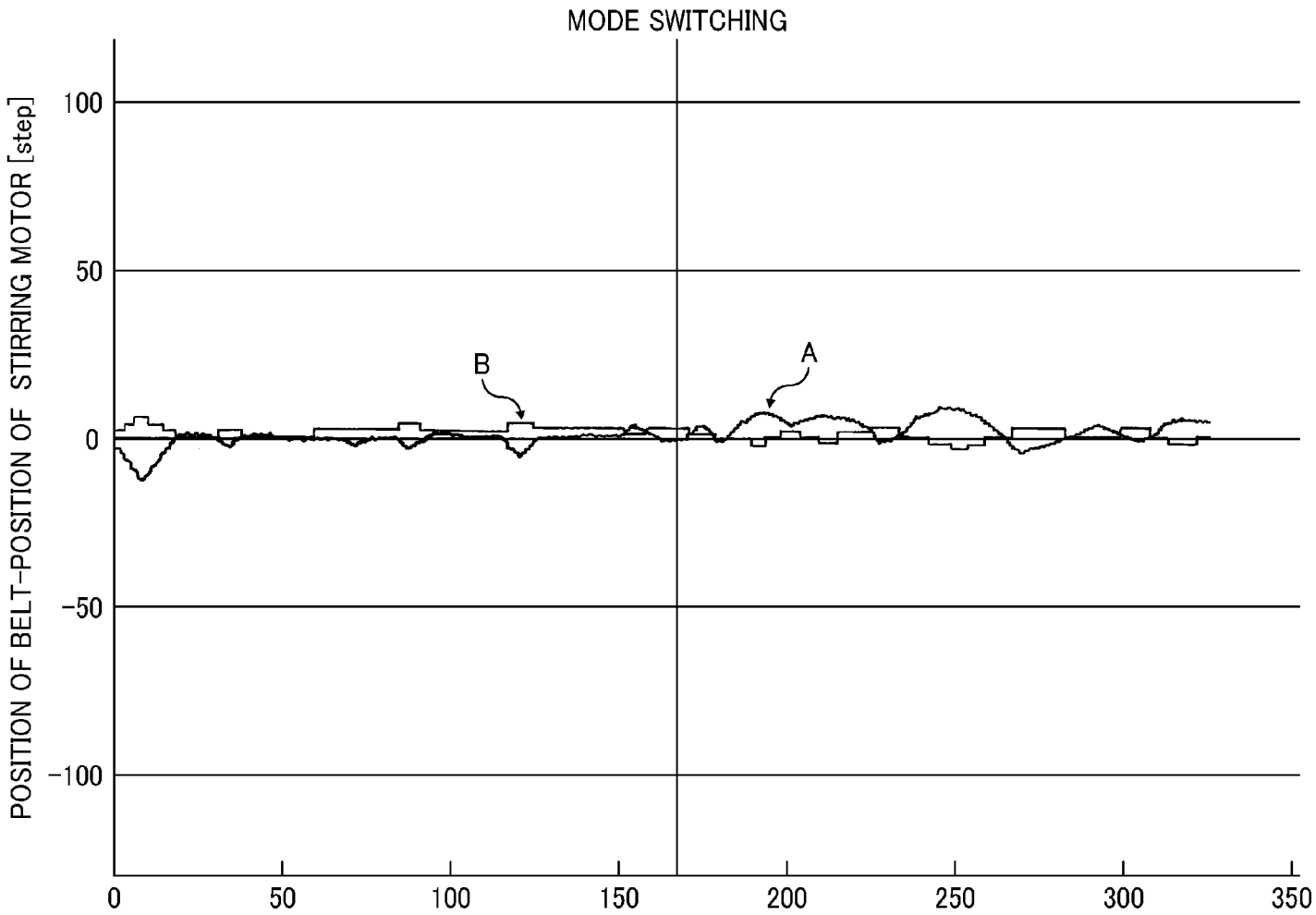
FIG. 5 is a line chart illustrating respective changes in positions of a belt and a steering motor when a steering roller is located almost at the same position before and after switching image formation modes.

FIG. 5 is a graph illustrating changes in position of the steering motor [step] (the curve B) and belt position [μm] (the curve A) when the steering roller 3 is located almost at the same position (i.e., inclination) before and after the image formation modes are switched. In this situation, it is understood from the drawing that their behavior does not greatly vary when the modes are switched. One embodiment of the present invention attempts to obtain the same result of the above-described behavior when modes are switched using a position adjustment roller 20 serving as another roller used in correcting displacement in addition to the steering roller 3.

Figure 6:
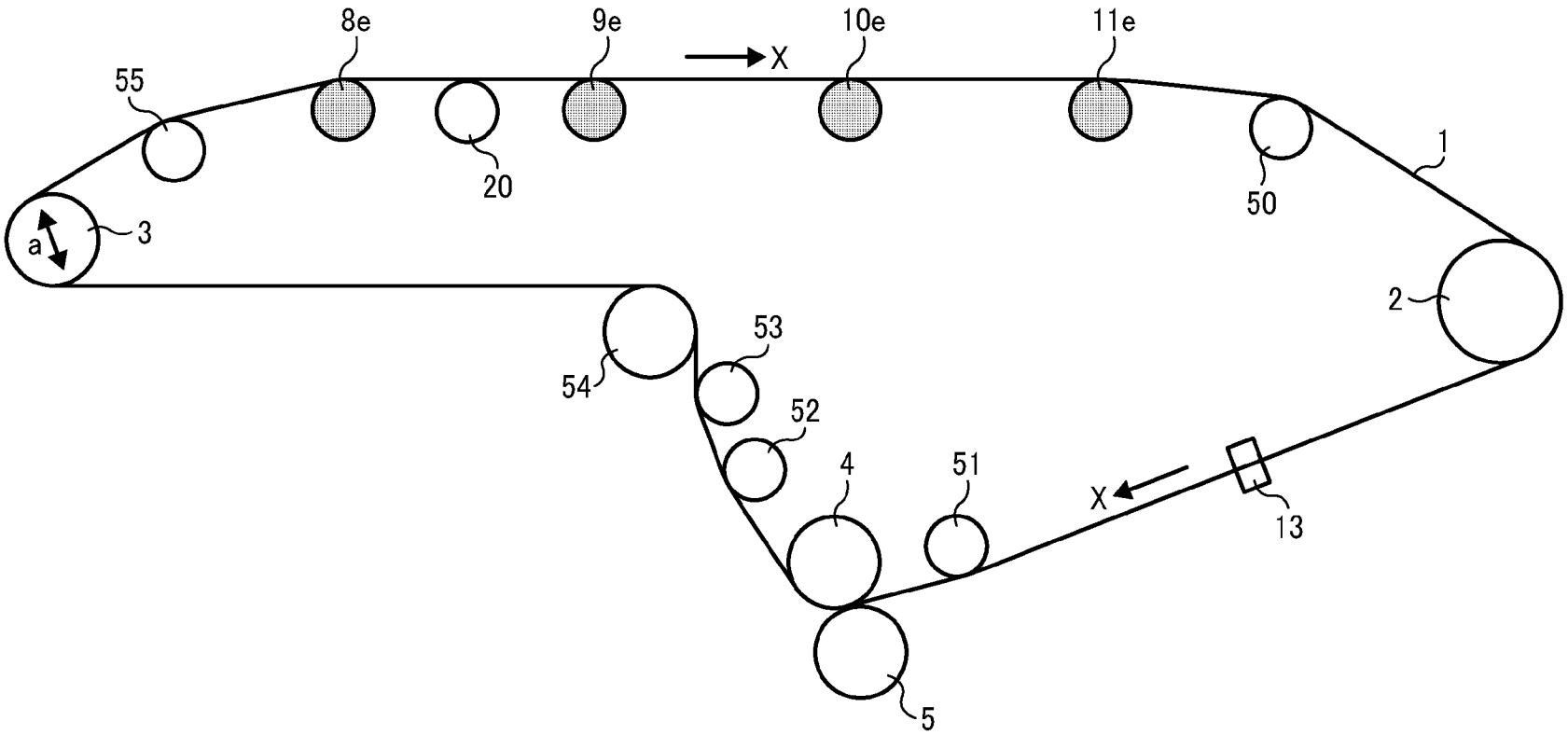
FIG. 6 is a diagram illustrating a condition of an intermediate transfer belt and contactable rollers thereon in an all-color mode in the image forming apparatus shown in FIG. 1.
Figure 7:
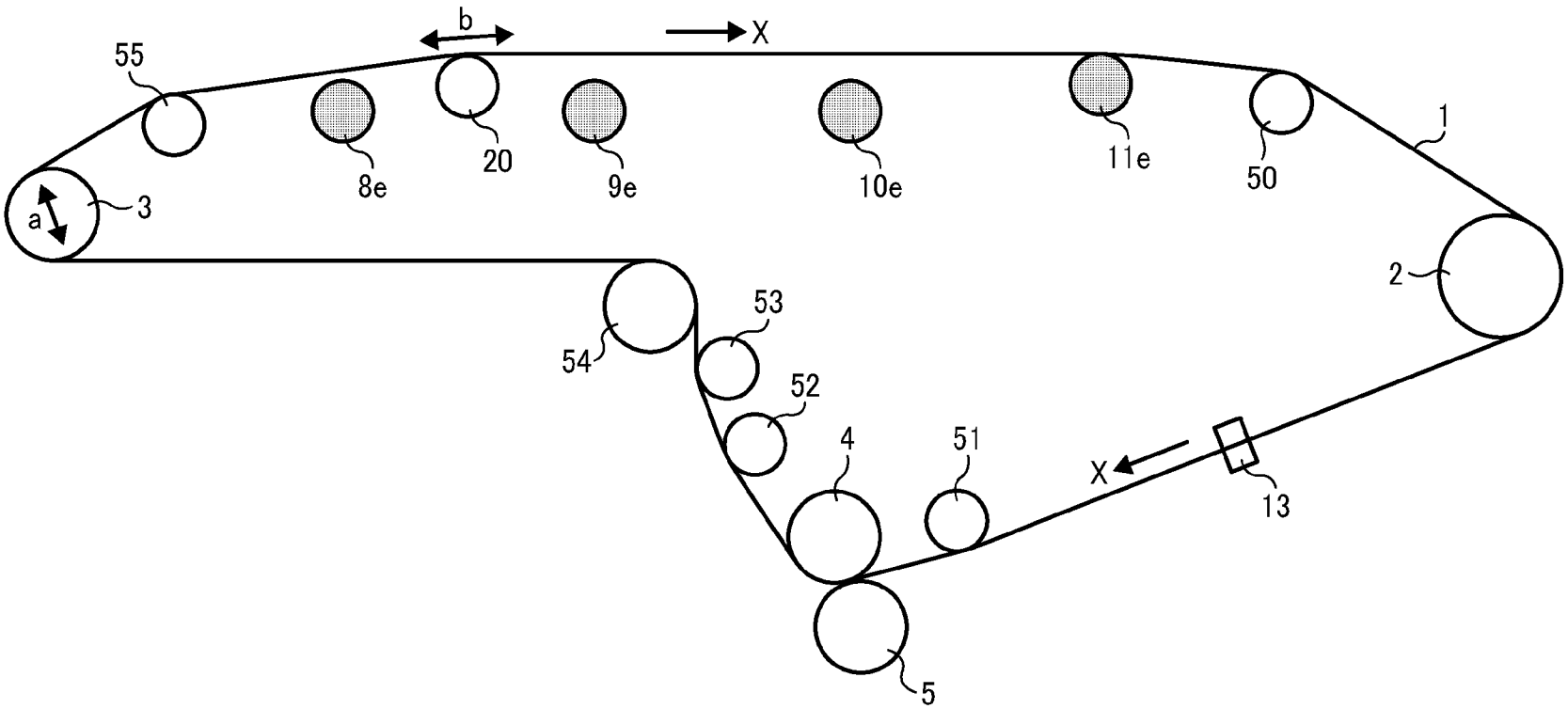
FIG. 7 is a diagram similarly illustrating a condition of an intermediate transfer belt and contactable rollers thereon in a monochromatic mode in the image forming apparatus shown in FIG. 1.
Figure 8:
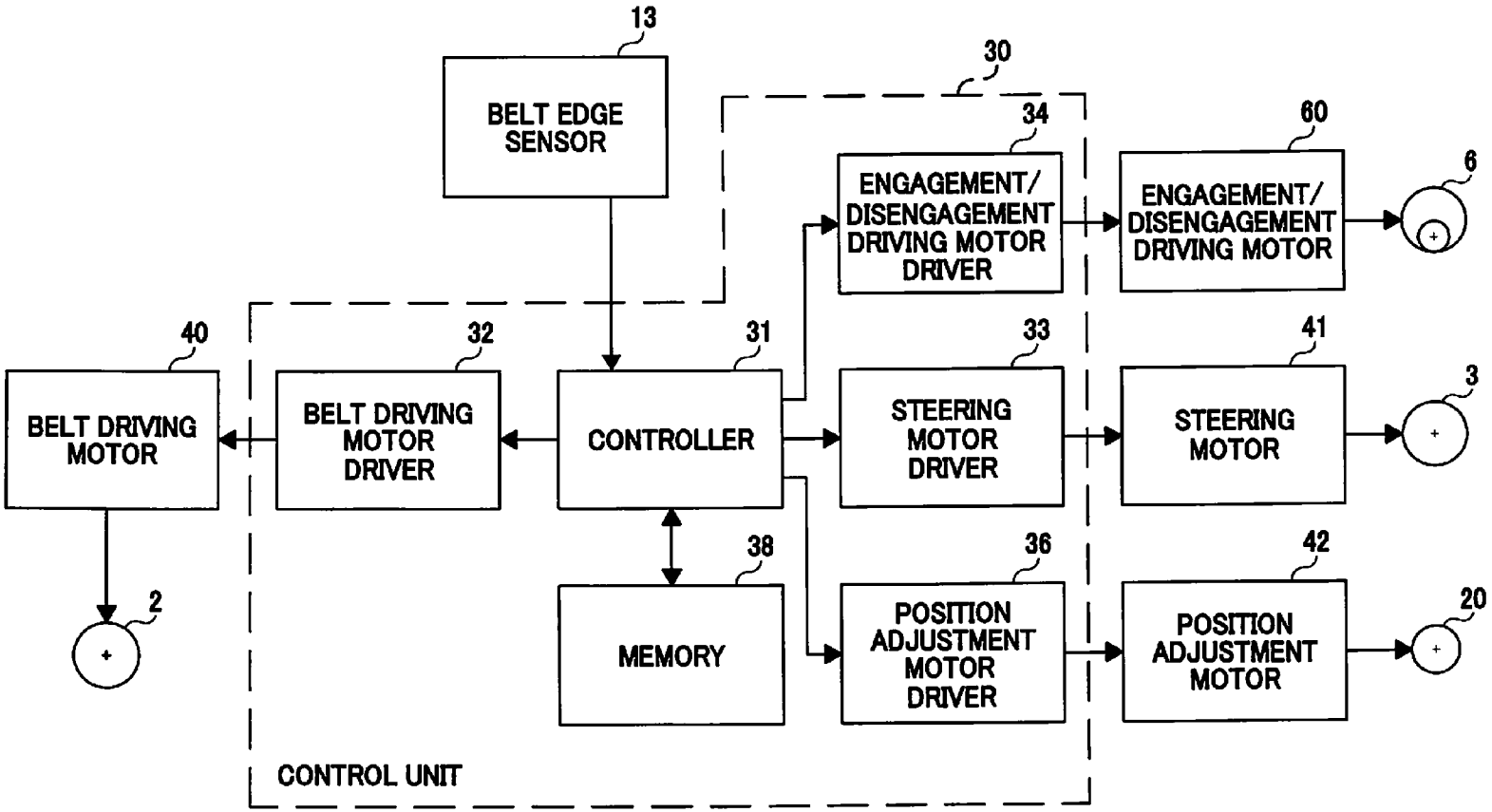
FIG. 8 is a block chart illustrating an exemplary configuration of a control unit and relevant parts thereto shown in FIG. 1 according to a first embodiment of the present invention.

Now, an essential portion and a control manner thereof according to a first embodiment of the present invention are described mainly with reference to FIGS. 6 to 11. Specifically, FIGS. 6 and 7 are diagrams each illustrating the intermediate transfer belt 1 as a belt provided in an image forming apparatus shown in FIG. 1 and contactable rollers thereon. FIGS. 6 and 7 suggest conditions in all-color and monochromatic modes, respectively. FIG. 8 is a block chart illustrating a configuration of the control unit 30 and relevant parts thereto in the first embodiment of present invention.

As described with reference to FIG. 1 and more apparently described with reference to FIGS. 6 and 7, the intermediate transfer belt 1 is stretched by a driving roller 2, a steering roller 3, a secondary transfer opposed roller 4, and numerous driven rollers 50 to 55 generating a certain amount of tension therein. Further, by circulating the intermediate transfer belt 1 based on rotation of the driving roller 2 at a predetermined speed in a direction as shown by arrow X and moving one side end of the steering roller 3 in a direction perpendicular to an expanding direction of the intermediate transfer belt 1 thereby slightly inclining thereof as indicated by arrow "a", the displacement is controlled without changing a perimeter thereof as the steering system. That is, the belt position detected by the belt edge sensor 13 is controlled to become a reference position to eliminate the displacement of the intermediate transfer belt 1 in its widthwise direction (i.e., a direction perpendicular to a sheet surface of the drawing).

During an all-color mode (i.e., a full-color mode) in this embodiment, all of the image formation units 8, 9, 10, and 11 of respective yellow (Y), magenta (M), cyan (C), and black (K) colors are used in forming a full-color image. Thus, the color bracket 7 is elevated by the engagement/disengagement mechanism 6 shown in FIG. 1, and each of the primary transfer rollers 8*e*, 9*e*, and 10*e* for Y, M, and C colors rises and contacts the intermediate transfer belt 1 as shown in FIG. 6. Hence, all of the primary transfer rollers including the primary transfer roller 11*e* used in transferring a K-color image faces the respective photoconductive drums 8*a*, 9*a*, 10*a*, and 11*a* in the image formation units 8, 9, 10, and 11 across the intermediate transfer belt 1.

Whereas in a monochromatic mode (i.e., black & white), image formation is executed only using the image formation unit 11 corresponding to black (K) color. Therefore, the color bracket 7 is lowered by the engagement/disengagement mechanism 6 shown in FIG. 1, and accordingly each of the primary transfer rollers 8*e*, 9*e*, 10*e* for Y, M, and C uses descends as shown in FIG. 7, and is separated from the intermediate transfer belt 1. Therefore, only K-color primary transfer roller 11*e* faces the photoconductive drum 11*a* of the image formation unit 11 across the intermediate transfer belt 1.

In this way, a path of the intermediate transfer belt 1 between the driven roller 55 and the primary transfer roller 11*e* used in transferring the K-color image is pinched by the respective photosensitive drums 8*a*, 9*a*, 10*a*, and 11*a* used in transferring the Y, M, and C color images and the primary transfer rollers 8*e*, 9*e*, and 10*e* used in the all-color mode, and is released therefrom in the monochromatic mode. If all of the primary transfer rollers 8*e*, 9*e*, 10*e*, and 11*e* are completely horizontal, stretching posture of the intermediate transfer belt 1 does not fluctuate even when image formation modes are switched. However, because each of them actually has slight inclination, the stretching posture of the intermediate transfer belt 1 varies when image formation modes are switched, thereby causing the above-described displacement.

Then, a position adjustment roller 20 is disposed extending in a widthwise direction of the intermediate transfer belt 1 on the same side as the primary transfer rollers of the intermediate transfer belt 1 at a section changing the posture. In this embodiment, the position adjustment roller 20 is disposed between the primary transfer roller 8*e* for Y-color and the primary transfer roller 9*e*.

More specifically, the position adjust roller 20 is located such that an outer circumferential surface thereof is slightly separated from the intermediate transfer belt 1 as shown in FIG. 6 in the all-color mode. Whereas, in a monochromatic mode, the position adjustment roller 20 is located such that the outer circumferential surface contacts the intermediate transfer belt 1 at a prescribed winding angle as shown in FIG. 7. Otherwise, the outer circumferential surface of the position adjustment roller 20 can contact the intermediate transfer belt 1 at no (i.e., zero degree of angle) or few winding angles in the all-color mode, while contacting the intermediate transfer belt 1 at a greater winding angle than in the all-color mode in the monochromatic mode.

As shown in FIG. 8, the control unit 30 includes a controller 31, a belt driving motor driver 32, a steering motor driver 33, an engagement/disengagement-driving motor driver 34, a position adjustment motor driver 36, and a memory 38. The control unit 30 also functions as a control unit for generally controlling the image forming apparatus. However, FIG. 8 only shows a configuration directly related to the present invention here.

The controller 31 has a micro-computer with a CPU, a ROM, and a RAM or the like. The controller 31 receives a detected value (corresponding to a position of the belt) from the belt edge sensor 13, and controls the belt driving motor driver 32, the steering motor driver 33, the engagement/disengagement-driving motor driver 34, the position adjustment motor driver 36, and the memory 38.

The belt driving motor driver 32 drives a belt driving motor 40 that rotates the driving roller 2 under control of the controller 31, and circulates the intermediate transfer belt 1 at a predetermined speed. The steering motor driver 33 is controlled by controller 31 and normally and reversely rotate a steering motor 41 as a stepper motor, and inclines the steering roller 3 through a moving mechanism, not shown, in the direction (i.e., a direction shown by arrow "a" in FIGS. 6 and 7) not to change the perimeter of the intermediate transfer belt 1 as described-above, thereby executing the displacement control as the steering system. Therefore, these devices correspond to the steering controller.

The engagement/disengagement driving motor driver 34 is controlled by the controller 31 and drives the engagement/disengagement-driving motor 60, and moves each of the primary transfer rollers 8*e*, 9*e*, and 10*e* for Y, M, and C colors through the engagement/disengagement mechanism 6 and the color bracket 7 shown in FIG. 1. Further, as shown in FIG. 6, the engagement/disengagement-driving motor driver 34 causes all of the primary transfer rollers 8*e*, 9*e*, and 10*e* to contact the intermediate transfer belt 1 in the all-color mode. Whereas in the monochromatic mode, as shown in FIG. 7, the engagement/disengagement driving motor driver 34 causes all of the primary transfer rollers 8*e*, 9*e*, and 10*e* to separate from the intermediate transfer belt 1 in the monochromatic mode. These correspond to the engagement/disengagement device.

The position adjustment motor driver 36 is controlled by the controller 31 and causes a position adjustment motor 42 as a stepping motor to generate stepwise rotation in both normal and opposite directions and moves one side end of an axis of the position adjustment roller 20 shown by arrow "b" through a mechanism, not shown, in the monochromatic mode as shown in FIG. 7. Hence, by slightly inclining the position adjustment roller 20 in a direction not to change the perimeter of the intermediate transfer belt 1, the position of the intermediate transfer belt 1 in its widthwise direction (i.e., a direction perpendicular to a sheet of drawing) is adjusted to cancel the displacement of the belt even if the inclination of the steering roller 3 is equalized to the stable position cancelling the displacement in the all-color mode. These correspond to the belt position adjuster as described later more in detail.

The memory 38 stores the rotation step number (e.g. a positive or negative integer) of the steering motor 41 as information indicating a stable position of inclination of the steering roller 3. Specifically, the memory 38 stores the rotation step number when the controller 31 determines that a prescribed condition is met, for example, when a detected value (corresponding to a position of the belt) of the belt edge sensor 13 falls within a prescribed range of the reference position, and the like, during belt control (i.e., steering control) in the all-color mode. Further, an optimum value on design is preset as a default number of rotation steps for the steering motor 41 and is stored in the memory as an initial target when belt control is executed in all-color and monochromatic modes. The memory 38 can be substituted by the ROM, the RAM, or the NV-RAM included in the controller 31.

Now, exemplary processing executed by the control unit 30 according to a first embodiment is described with reference to FIGS. 9 to 11.

Initially, a situation when image formation is started in an all-color mode is described. When image formation is started in the all-color mode shown in FIG. 6, a process shown in FIG. 9 is started. Then, "belt control in an all-color mode" is executed as a starter in step S1. Subsequently, image formation is executed in the all-color mode. According to one embodiment of the present invention, variation in displacement of the intermediate transfer belt 1 is relatively small (when the image formation is started in the all-color mode). Therefore, when high image quality is not needed, i.e., some color misalignment is accepted, "belt control in the all-color mode" may be executed in parallel after image formation in the all-color mode is started.

Figure 9:
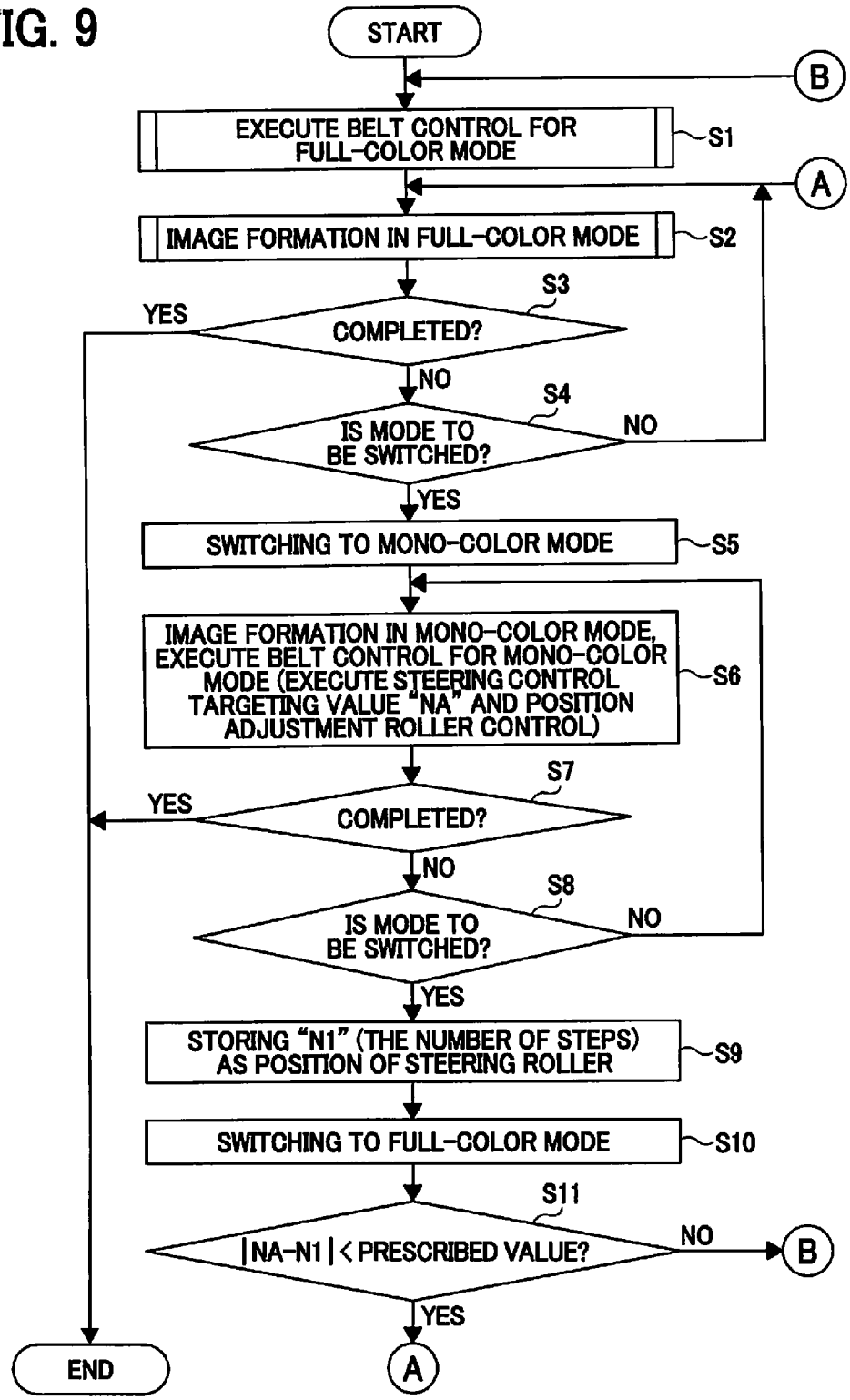
FIG. 9 is a flowchart illustrating a process executed in a main routine by the control unit when image formation is started in an all-color mode according to the first embodiment of the present invention.
Figure 11:
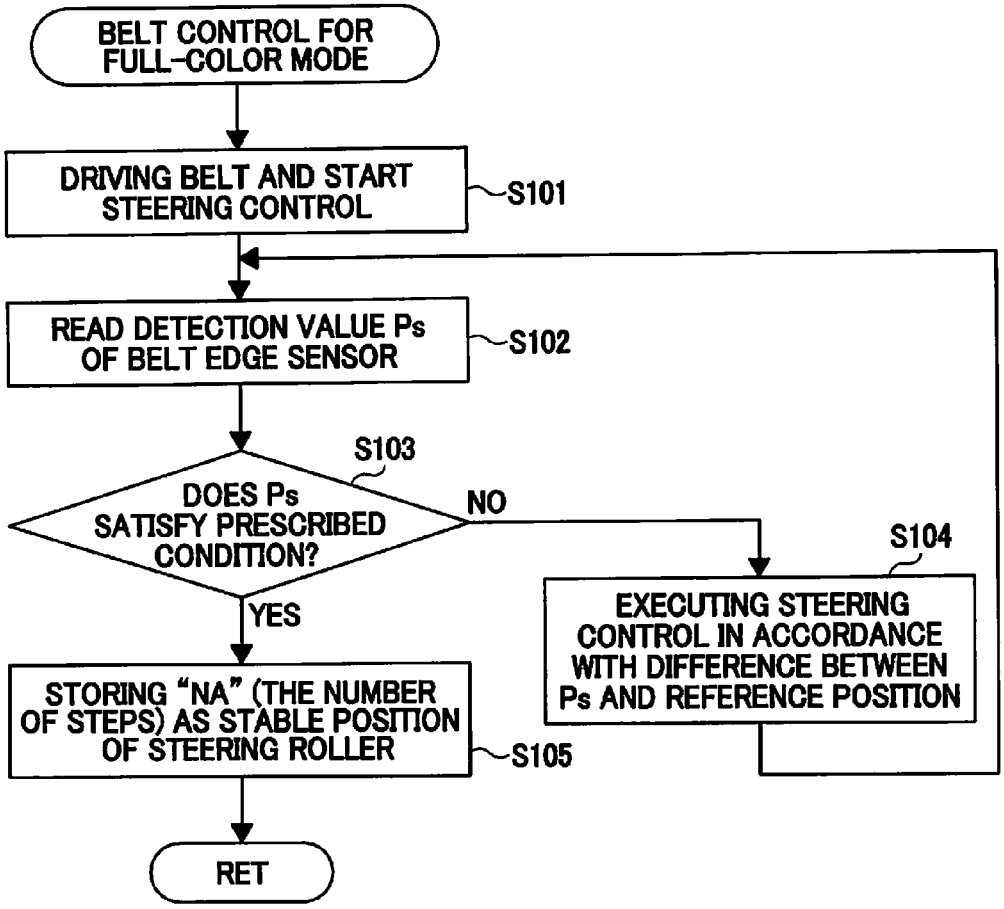
FIG. 11 is a flowchart illustrating a subroutine pursued in controlling the belt in the all-color mode shown in FIGS. 9 and 10.

In a subroutine from "belt control in the all-color mode" in step S1 of FIG. 9, belt driving and steering control processes are started in step S101 as shown in FIG. 11. The belt driving process is a process in which the belt driving motor 40 is driven to rotate the driving roller 2 shown in FIG. 6 and circulate the intermediate transfer belt 1 in a direction shown by arrow X at a predetermined speed. The steering control process is a process in which the steering motor 41 as a stepping motor causes stepwise rotation in a forward or reverse direction and inclines the steering roller 3 in a direction not to change the perimeter of the intermediate transfer belt 1, thereby controlling the displacement with the steering system.

When initially executing the "belt control in the all-color mode", the steering motor 41 is controlled to rotate by an amount of the number of rotation steps to meet an optimum default value NAd on design stored in the memory 38 beforehand as a target for the steering motor 41 in the all-color mode, thereby starting this control process inclining the steering roller 3. When the "all-color mode belt control" is already executed, the number of steps NA as information indicating a stable position of inclination of the steering roller 3 at that time is stored beforehand. Therefore, the steering motor 41 is controlled to start rotating while targeting the value (i.e., NA).

Further, in step S102, a detected value Ps indicating the position of the intermediate transfer belt 1 in its widthwise direction is read from the belt edge sensor 13. Subsequently, it is determined whether the detected value Ps meets predetermined condition in step S103. Here, the predetermined condition mean that the detected value Ps continuously falls within a predetermined range (a reference position±A) of the reference position over a given time. The steering control is executed in step S104 in accordance with a difference (e.g. positive or negative differences) between the detected value Ps and the reference value, and such reading of the detected value Ps in step S102 and the determination in step S103 are repeated until the determination becomes positive (YES, in step S103).

When determination in step S103 is positive (i.e., YES), since the steering roller 3 becomes stable, the number of steps (a positive or negative integer) rotating the steering motor 41 until then from an initial position is stored in the memory 38 shown in FIG. 8 as a stable position NA of inclination of the steering roller 3 in step S105. Then, the sequence returns to the main routine of FIG. 9.

In the next step S2 of the main routine, image formation is executed in the all-color mode. This process is the same as an ordinary image formation process executed in a full-color mode employing each of image formation units 8, 9, 10, and 11 for Y, M, C, and K colors. Thus, specific description is omitted here. When "all-color mode belt control" is executed in parallel to image formation in the all-color mode after it is started, similar belt control is executed to that executed in the subroutine shown in FIG. 11. However, after the stable position NA of the inclination of the steering roller 3 is stored, the image formation process continues in the all-color mode maintaining such a controlled state.

When the image formation process for an amount of a sheet is completed, it is determined if image formation is terminated (i.e., if data to form an image is missing) in step S3. When it is determined to be terminated, processing of the main routine is terminated. When the determination is negative (i.e., No) in step S3, it is further determined whether modes are to be switched in step S4. When the modes are not to be switched, the process returns to step S2, and the image formation is repeated in the all-color mode.

By contrast, when it is determined in step S4 that the modes are to be switched, the current mode is switched to a monochromatic mode shown in FIG. 7 in step S5. However, because color displacement does not occur in the monochromatic mode, image formation is immediately started in the monochromatic mode in step S6. Since the image formation in the monochromatic mode is the same as a typical monochromatic mode executed by using only the image formation unit 11 for K-color, detailed description is omitted here. In step S6, belt control in the monochromatic mode is executed in parallel to the image formation in the monochromatic mode. Specifically, the position adjustment roller 20 is controlled while circulating the intermediate transfer belt 1 with the belt driving motor 40 and executing the steering control targeting the stable position NA stored in the belt control in the all-color mode of the previous step S1.

Specifically, by rotating the steering motor 41 by an amount of the number of steps of the stable position NA stored in the memory 38 and equalizing the inclination of the steering roller 3 with the stable position defined in the previous belt control in the all-color mode, forward or backward stepping rotation of the position adjustment motor 42 as a stepping motor is caused, and the position adjustment roller 20 is inclined in a direction as shown by arrow "b" in FIG. 7 so that the detected value Ps of the belt edge sensor 13 as described above meets the prescribed condition.

The reason for using the stable position NA previously stored as a steering control target is to allow immediate start of image formation in an all-color mode by equalizing the inclination of the steering roller 3 as much as possible with the stable position defined in the previous all-color mode when the current mode is switched to the all-color mode. Further, the reason for controlling belt driving so that the detected value Ps of the belt edge sensor 13 meets a predetermined condition although the color displacement does not occur in the monochromatic mode is described below. Specifically, when a position of the intermediate transfer belt 1 excessively deviates in the widthwise direction, the intermediate transfer belt 1 may contact other parts causing defective rotation or is damaged in an extreme situation. Thus, the intermediate transfer belt 1 is desirably located at a prescribed position in view of operating stability in any mode.

When the image formation process for an amount of a sheet is completed in step S6, it is determined if the image formation is terminated (whether or not data for image formation is missing) in step S7. When it is determined to be terminated, processing in this main routine is terminated. By contrast when determination is not to terminate in step S7, it is further determined whether the modes are to be switched in step S8. When the modes are not to be switched in step S8, the process returns to step S6, and the above-described belt control and image formation are repeated in the monochromatic mode.

By contrast, when it is determined that modes are to be switched in step S8, the number (e.g. a positive or negative integer) of rotation steps rotating the steering motor 41 from the initial position, equivalent to an inclination of the steering roller 3 at that time, is stored in the memory 38 as a value N1 defined right before switching of the modes in step S9. When a target value at that time is already met in steering control, the value N1 obtained right before switching of the modes should be equal to the stable position NA defined in the previous all-color mode. However, the target value at that time is not already met in the steering control before the modes are switched, the value (number of steps) N1 different from NA is stored.

Further, after switching to the all-color mode in step S10 shown in FIG. 6, it is determined whether a difference (i.e., an absolute value) between N1 obtained right before mode switching and the stable position NA defined in the previous all-color mode, i.e. |NA−N11, is less than a given value in step S11. If the difference between the NA and N1 is less than a predetermined level, and the difference between a position of the steering roller 3 before switching of the modes and the stable position of the steering roller 3 in the all-color mode is small (or almost the same), The process returns to step S2 and image formation is performed in the all-color mode. Thus, in this situation, the image formation can be immediately started in the all-color mode without a waiting time. Specifically, since N1 is almost the same as the NA in most cases, image formation of the all-color mode is immediately started.

However, when a monochromatic mode is switched to an all-color mode within a short time period after entering the monochromatic mode, the value N1 is not yet almost the same as the NA, and determination becomes negative (i.e., No) in step S11. In that situation, since a difference of the position of the steering roller 3 right before mode switching and the stable position of the steering roller 3 in the all-color mode is great, the process retunes back to step S1 and executes the belt control in the all-color mode (FIG. 11), and after that the image formation in the all-color mode is executed in step S2. Subsequently, the above-described processes are repeated until it is determined that the process is completed in one of steps S3 and S7.

Now, a situation when image formation is started in a monochromatic mode is described. When image formation is started in the monochromatic mode as shown in FIG. 7, a process shown in FIG. 10 is started. Subsequently, image formation is executed in the monochromatic mode, and the "belt control in a monochromatic mode" is executed in parallel thereto in step S6 of FIG. 9.

Specifically, by circulating the intermediate transfer belt 1 with the belt driving motor 40, the steering control is executed targeting the stable position NA stored in the memory 38 during the previous belt control in the all-color mode and the position adjustment roller 20 is controlled and adjusted so that the detected value Ps of the belt edge sensor 13 meets the prescribed condition. When the "all-color mode belt control" is not yet executed and the stable position NA has not been stored, a default value NAd of the number of rotation steps of the steering motor 41 stored in the memory 38 beforehand as an optimum value for an all-color mode on the design is targeted in executing the steering control.

When the image formation process for an amount of a sheet is completed in step S21, it is determined if image formation is terminated in step S22. When it is determined to be terminated, processing of the main routine is terminated. When the determination is negative (i.e., No) in step S22, it is further determined whether modes are to be switched in step S23. When the modes are not to be switched, the process retunes to step S21, and the image formation and the above-described belt control are repeated in the monochromatic mode.

By contrast, when it is determined that the modes are to be switched in step S23, the number (e.g. a positive or negative integer) of rotation steps rotating the steering motor 41 from the initial position, equivalent to an inclination of the steering roller 3 at that time, is stored in the memory 38 as a value N1 defined right before switching of the modes in step S24. When the target value is already met at that time in the steering control (or the last steering control is already a prescribed preferable level), the value N1 defined right before switching of the modes should be equal to the stable position NA defined in the previous all-color mode or the default value NAd.

Subsequently, the current mode is switched to the all-color mode in step S25 shown in FIG. 6, and it is determined whether a difference (absolute value), i.e. |NA−N1|, between the values N1 obtained right before switching of the modes and the stable position NA defined in the all-color mode is less than a given value in step S26. If the difference between the NA and N1 is less than a predetermined level, since the difference between a position of the steering roller 3 before switching of the modes and the stable position of the steering roller in the all-color mode is small (or almost the same), the process returns to step S27, and image formation is performed in the all-color mode. Thus, in this situation, the image formation can be immediately started in the all-color mode without a waiting time.

By contrast, when the determination is negative (i.e., No) in step S26, since a difference of the position of the steering roller 3 right before mode switching and the stable position of the steering roller 3 defined in the all-color mode is relatively great, the process retunes back to step S28 and the belt control in the all-color mode (see FIG. 11) is executed, and after that the image formation in the all-color mode is executed in step S27. Since the stable position NA is not stored at the beginning of the process, the difference |NA−N1| is never less than the given value, and the belt control is executed in the all-color mode in step S28.

However, since the value N1 is usually almost the same as NAd when the modes are switched, the steering control is started with almost the default value NAd in a subroutine of the "belt control in the all-color mode" shown in FIG. 11. However, the detected value Ps of the belt edge sensor 13 immediately meets the prescribed condition, so that the number of steps rotating the steering motor 41 from the initial position until that time can be stored as the stable position NA of the steering roller 3. Subsequently, the image formation can be started immediately in the all-color mode in step S27.

When the image formation process for an amount of a sheet is completed in step S27, it is determined if the image formation is terminated in step S29. When it is determined to be terminated, processing in this main routine is terminated. By contrast when determination is not to be terminated in step S29, it is further determined whether the modes are to be switched in step S30. When the modes are not to be switched in step S30, the process returns to the step S27, and the image formation is repeated in the all-color mode.

By contrast, when it is determined in step S30 that the modes are to be switched, it is switched to a monochromatic mode shown in FIG. 7 in step S31. Then, the process returns to step S21, and belt control and image formation in the monochromatic mode are executed in parallel. Subsequently, the above-described processes are repeated until it is determined that the process is completed in one of steps S22 and S29.

Figure 10:
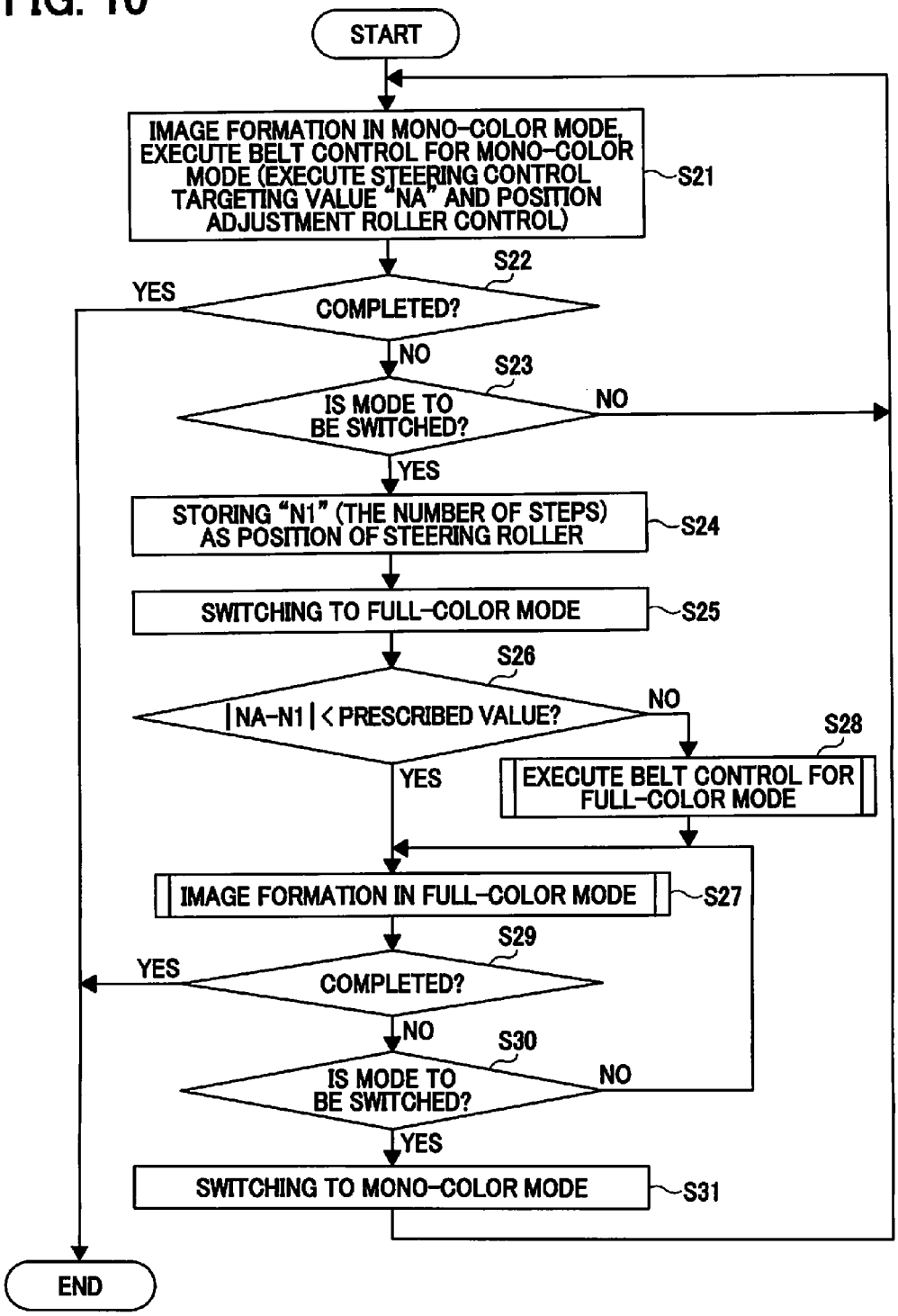
FIG. 10 is a flowchart illustrating a process of a main routine pursued by the control unit when image formation is started in a monochromatic mode.

As described-above, in steps S11 and S26 shown in FIGS. 9 and 10, respectively, it is determined whether a difference, i.e. |NA−N1|, between the values N1 defined right before mode switching and the stable position NA defined in the previous all-color mode is less than a given value in step S11. However, it can be determined whether or not the difference is equal or less than the given value. In such a situation, when the difference is equal or less than the given value, the image formation can be immediately started in the all-color mode without a waiting time. The given value can be optionally designated.

Since the belt control executed in the monochromatic mode is the steering control targeting the stable position NA stored in the belt control as a target value in the last all-color mode, therefore, when the monochromatic mode is switched to the all-color mode, the difference |NA−N1| is often small, and accordingly the image formation can be mostly immediately started in the all-color mode without a waiting time. Otherwise, when the monochromatic mode is switched to the all-color mode in a situation in which slight color displacement is accepted, the determination about |NA−N1| is omitted and image formation is immediately started in the all-color mode and similar belt control as executed in the all-color mode may be executed in parallel thereto as described earlier. The value N1 defined right before switching of the modes is mostly almost the NA.

Now, an image forming apparatus according to a second embodiment of the present invention is described mainly with reference to FIGS. 12 to 22. A configuration of the image forming apparatus according to the second embodiment is almost the same as that of the first embodiment shown in FIG. 1. However, the steering roller 3 is shifted to the left from a position thereof shown in FIG. 1, and the intermediate transfer belt 1 is accordingly stretched on the left side of the image formation unit 8. Further, one more image formation unit is disposed on the left side (i.e., upstream in a traveling direction of the intermediate transfer belt 1) of the image formation unit 8 for Yellow (Y) arranged above the intermediate transfer belt 1.

Figure 12:
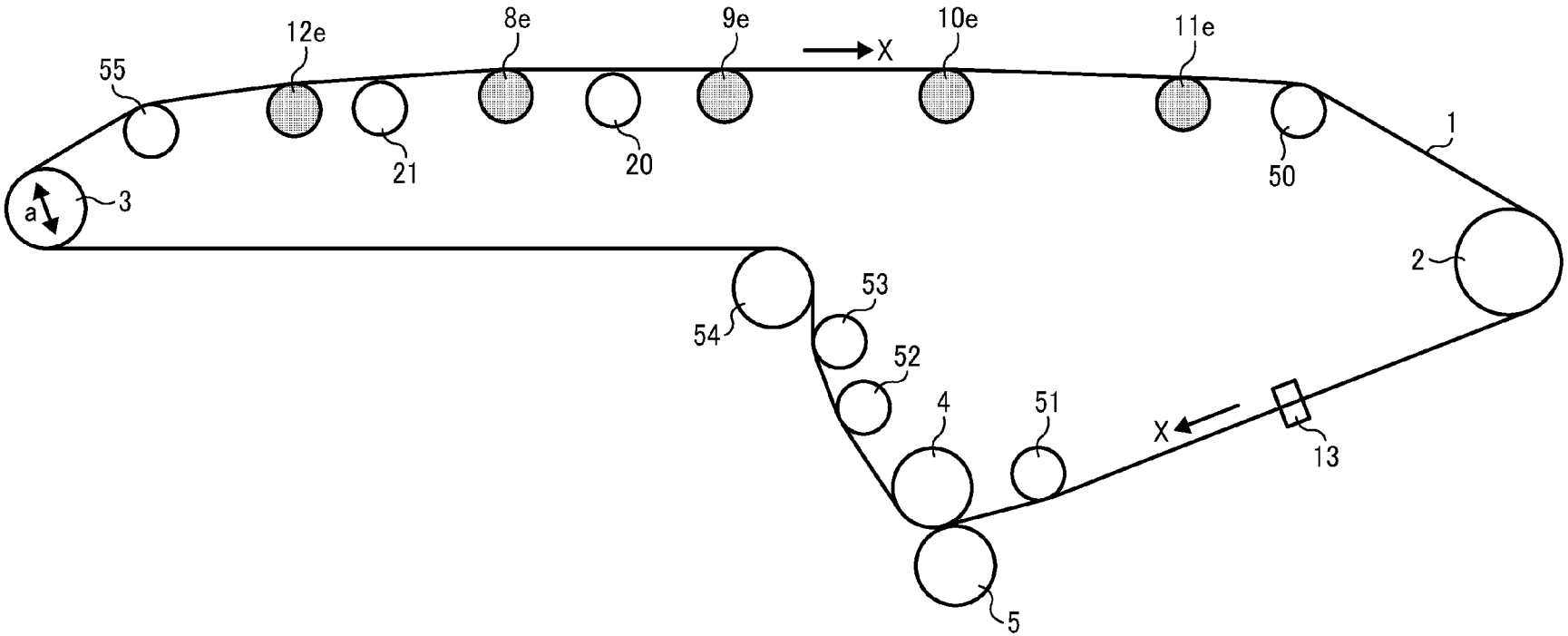
FIG. 12 is a diagram illustrating a condition of an intermediate transfer belt and contactable rollers thereon in an all-color mode in the image forming apparatus according to a second embodiment.

The one more image formation unit has almost the same configuration as the image formation units 8 to 11, but forms a special color image in a region not reproducible for the Y, M, C, and K colors. Therefore, a developing unit in the one more image formation unit uses special color toner. For example, a color of clear toner to generate a watermark or glossy, gold, and silver can be employed as the special color. In this respect, a primary transfer roller 12*e* is additionally provided at the position facing the photoconductive drum in the image formation unit for special color across the intermediate transfer belt 1 as shown in FIGS. 12 to 14.

Further, in this embodiment, an all-color mode is a mode to execute image formation using all image formation units for special, Y, M, C, and K colors, respectively. A four-color mode is a mode using all of the image formation units except for the special color and is equivalent to the all-color mode, i.e., a full-color mode in the above-described first embodiment. A monochromatic mode is a mode to execute image formation using only the image formation unit for K color, and is the same as the monochromatic mode in the first embodiment.

The primary transfer roller 12*e* for special color is moved up and down to multiple positions to contact and separate from the intermediate transfer belt 1 by an engagement/disengagement mechanism, such as an engagement/disengagement driving motor, a cam, and the like. separately provided from that for moving each of the primary transfer rollers 8*e*, 9*e*, and 10*e* for Y, M, and C colors. Further, in this second embodiment, all of the primary transfer rollers 8*e*, 9*e*, 10*e*, 11*e*, and 12*e* are caused to contact the intermediate transfer belt 1 when image formation is executed using all the image formation units as shown in FIG. 12.

Figure 13:
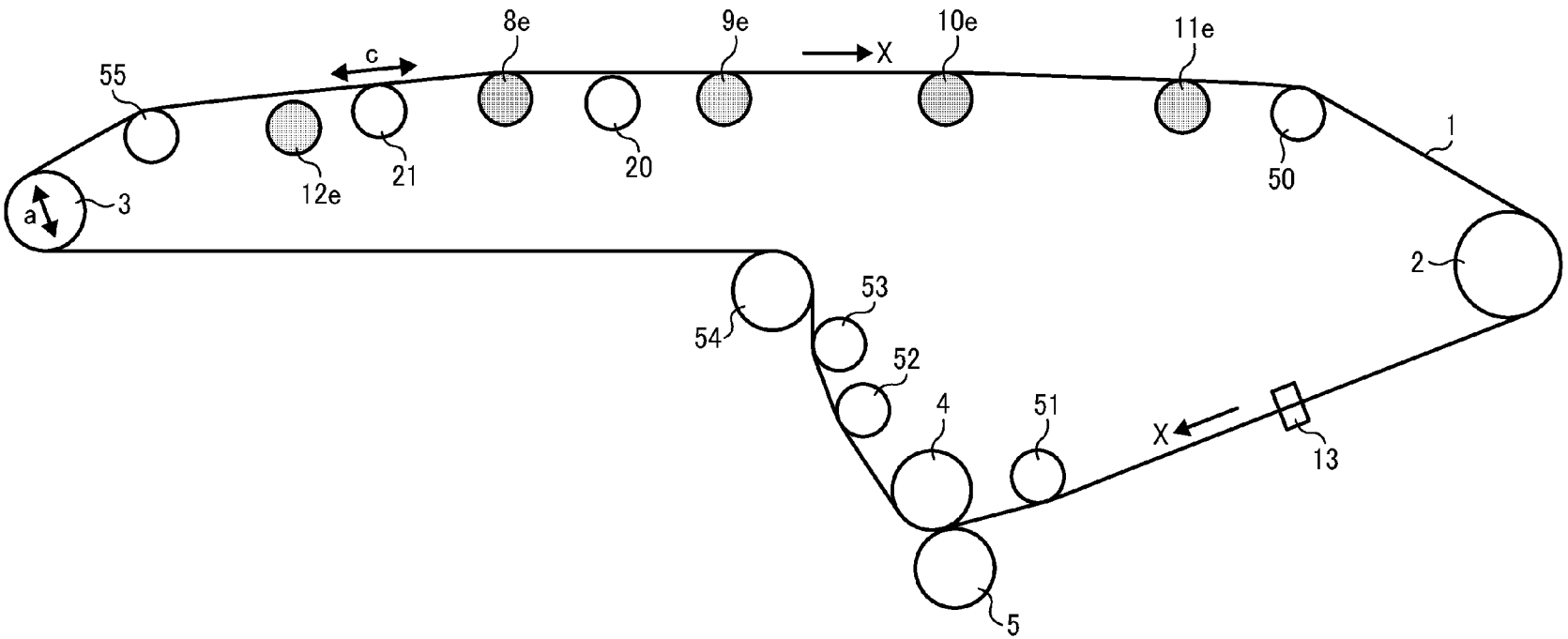
FIG. 13 is a diagram similarly illustrating a condition of the intermediate transfer belt and contactable rollers thereon in a four-color mode in the image forming apparatus.
Figure 14:
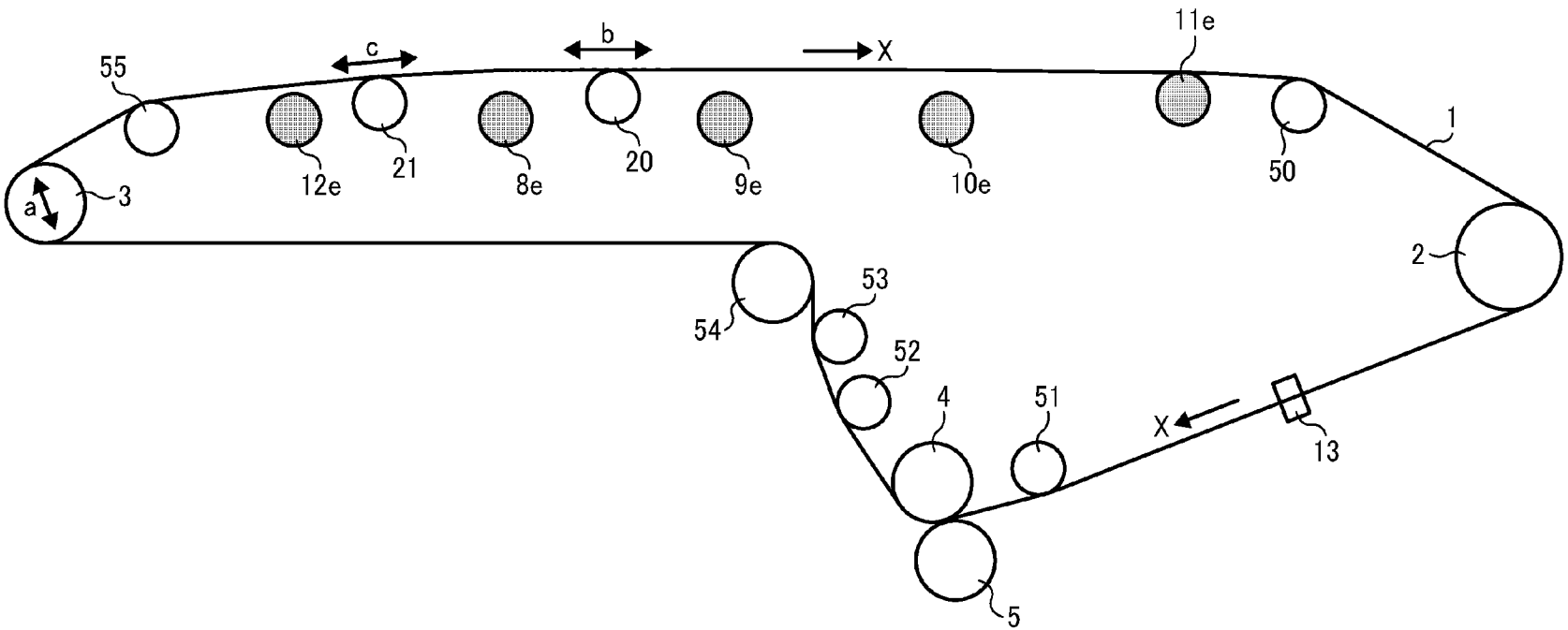
FIG. 14 is a diagram similarly illustrating a condition of the intermediate transfer belt and contactable rollers thereon in a monochromatic mode in the image forming apparatus.

When image formation is executed in the "four-color mode" using the four image formation units other than the special color image formation unit, only the primary transfer roller 12*e* for the special color separates from the intermediate transfer belt 1 as shown in FIG. 13. Whereas, when an image is formed in the monochromatic mode using only the image formation unit for K-color, the primary transfer rollers 8*e*, 9*e*, 10*e*, and 12*e* separate from the intermediate transfer belt 1, and only the primary transfer roller 11*e* for K-color is in contact with the intermediate transfer belt 1 as shown in FIG. 14.

Thus, according to the second embodiment, the primary transfer roller 12*e* is in contact with the intermediate transfer belt 1 in the all-color mode shown in FIG. 12, and the primary transfer roller 12*e* leaves the intermediate transfer belt 1 in the four-color mode as in FIG. 13. Therefore, a stretching posture of the intermediate transfer belt 1 again varies when the all-color mode and the four-color mode are switched.

Then, at a position where a stretching posture of the intermediate transfer belt 1 varies, one more position adjustment roller 21 is disposed on the same side as the primary transfer rollers of the intermediate transfer belt 1 along the widthwise direction thereof. In this embodiment, the position adjustment roller 21 is positioned between the primary transfer roller 8*e* for Y-color and the primary transfer roller 12*e* for special color.

An outer surface of the position adjustment roller 21 slightly separates from the intermediate transfer belt 1 in an all-color mode as shown FIG. 12. Whereas, the outer surface of the position adjustment roller 21 contacts the intermediate transfer belt 1 at a given winding angle both in monochromatic and four-color modes as shown in FIGS. 13 and 14, Otherwise, the outer surface of the position adjustment roller 21 contacts the intermediate transfer belt 1 at no winding angle or at a few winding angles, and contacts it at a prescribed greater winding angle in the monochromatic and four-color modes than in the all-color mode.

Further, the outer surface of the position adjustment roller 20 equivalent to the position adjustment roller 20 of the first embodiment contacts the intermediate transfer belt 1 at no or few winding angles both in the all-color and four-color modes as shown in FIGS. 12 and 13. Whereas, the outer surface of the position adjustment roller 20 contacts the intermediate transfer belt 1 at a given winding angle (greater than that in the all-color and four-color modes) in the monochromatic mode as shown in FIG. 14.

Figure 15:
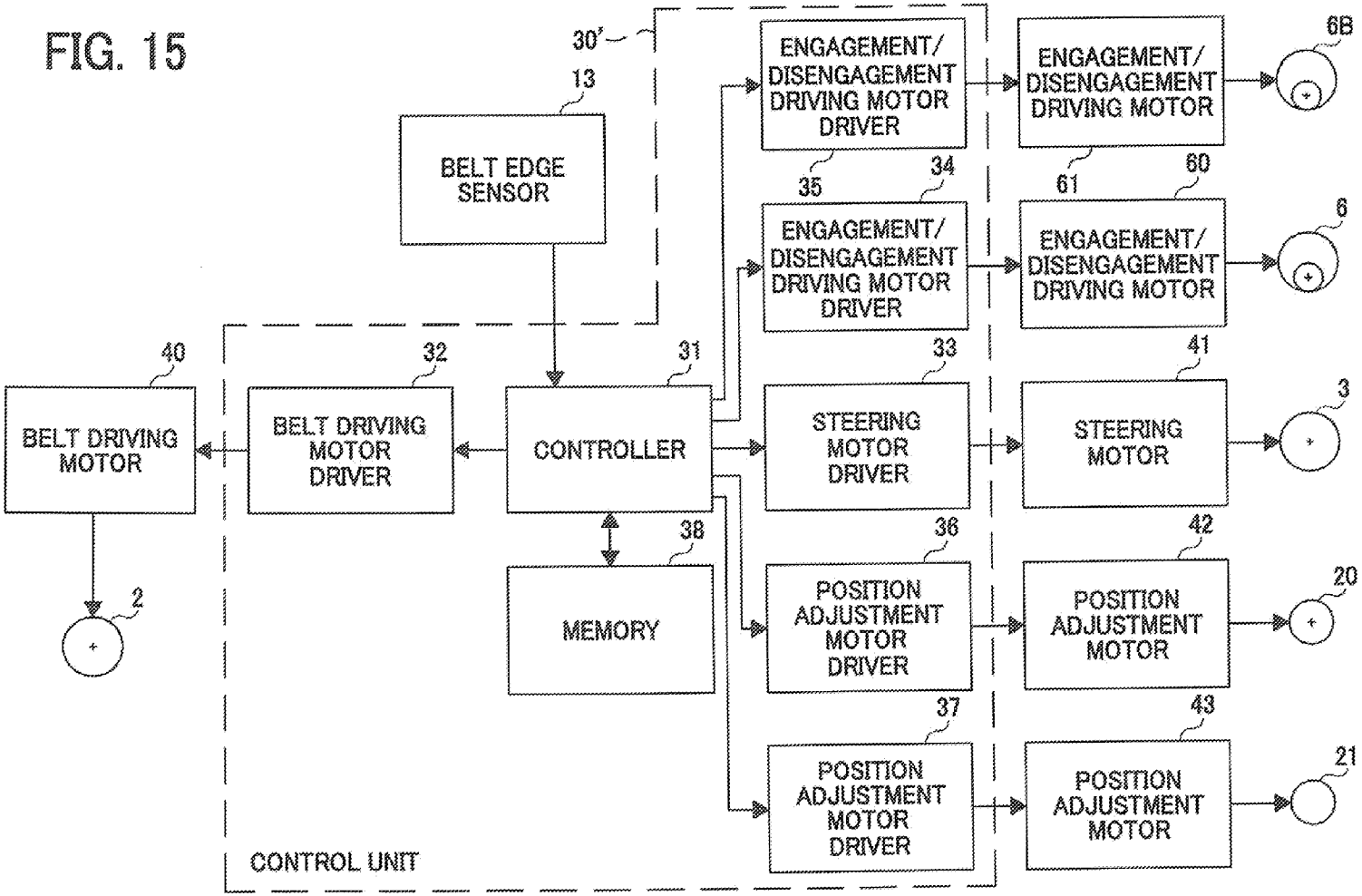
FIG. 15 is a block chart illustrating a configuration of a control unit and related parts thereto according to a second embodiment of present invention.

FIG. 15 is a block chart illustrating a configuration of the control unit and relevant parts thereto in the second embodiment of present invention corresponding to that of the first embodiment described with reference to FIG. 8. A control unit 30' is constituted based on the control unit 30 shown in FIG. 8 additionally including an engagement/disengagement driving motor driver 35 and a position adjustment motor driver 37.

The engagement/disengagement driving motor driver 35 is controlled by the controller 31 and drives the engagement/disengagement-driving motor 61, and moves the primary transfer roller 12*e* for the special color through an engagement/disengagement mechanism 6B. Specifically, as shown in FIG. 12, the engagement/disengagement driving motor driver 35 causes the primary transfer roller 12*e* to contact the intermediate transfer belt 1 in the all-color mode. Whereas in the monochromatic and four-color modes, as shown in FIGS. 13 and 14, the engagement/disengagement driving motor driver 35 causes the primary transfer roller 12*e* to separate from the intermediate transfer belt 1. Thus, these devices correspond to the engagement/disengagement device.

The position adjustment motor driver 37 is controlled by the controller 31 and causes the position adjustment motor 43 as a stepping motor to cause stepwise rotation in both normal or opposite directions shown by arrow "c" and moves one side end of an axis of the position adjustment roller 21 through a moving mechanism, not shown, in the four-color and monochromatic modes as shown in FIGS. 13 and 14. Hence, by slightly inclining the position adjustment roller 21 in a direction not to change the perimeter of the intermediate transfer belt 1, the position of the intermediate transfer belt 1 in its widthwise direction (i.e., a direction perpendicular to a sheet of drawing) is adjusted even when steering control is executed (at the same time) targeting the stable position NA stored in belt control executed in the last all-color or four-color mode. These devices correspond to the belt position adjuster.

Now, exemplary processing executed by the control unit 30' according to a second embodiment is described with reference to FIGS. 11 and 16 to 22. Although a process of a main routine is separately shown by two diagrams, a terminal of each flow line with the same symbol is connected.

Figure 22:
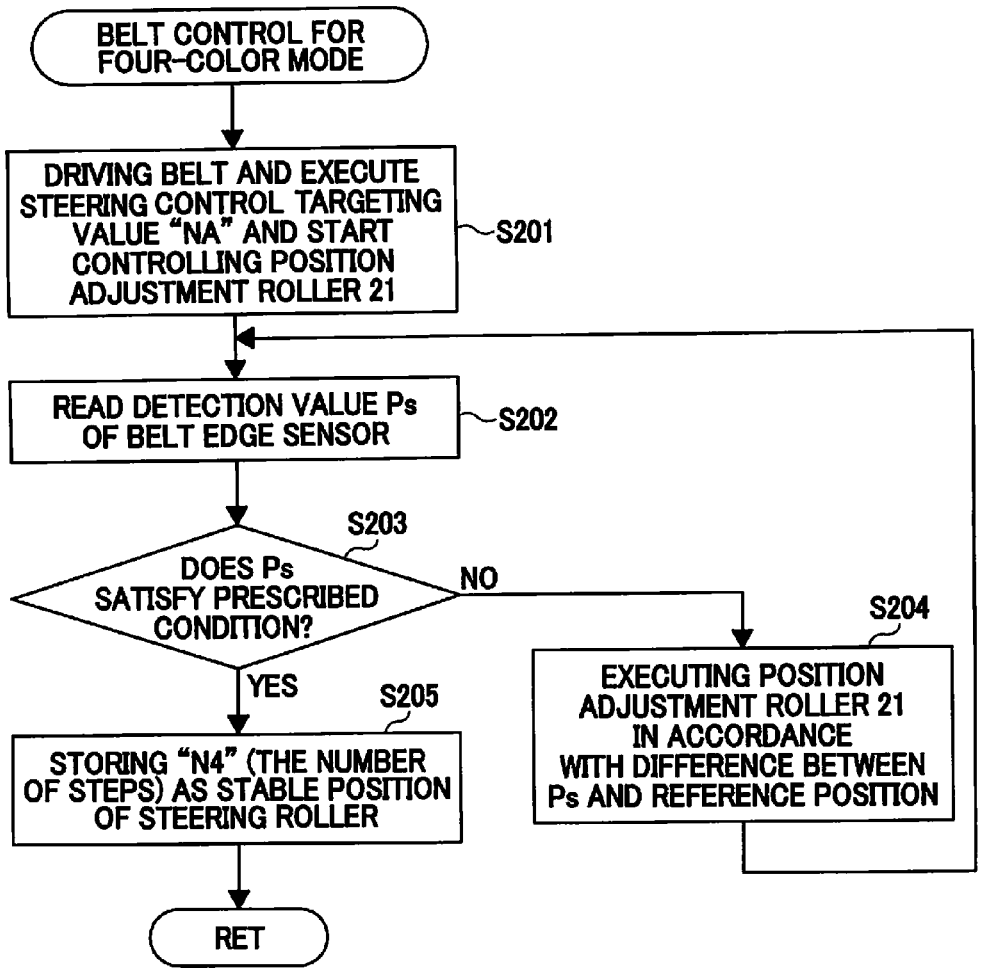
FIG. 22 is a flowchart illustrating a subroutine pursued in controlling the belt in the four-color mode shown in FIGS. 16, 18, and 20.

Because a subroutine of the belt control executed in the all-color mode as shown in FIG. 22 is the same as that of the first embodiment shown in FIG. 11, and repetitious description is omitted here. However, since the primary transfer roller 12*e* for special color is in contact with the intermediate transfer belt 1, an actual image formation mode is different.

Figure 16:
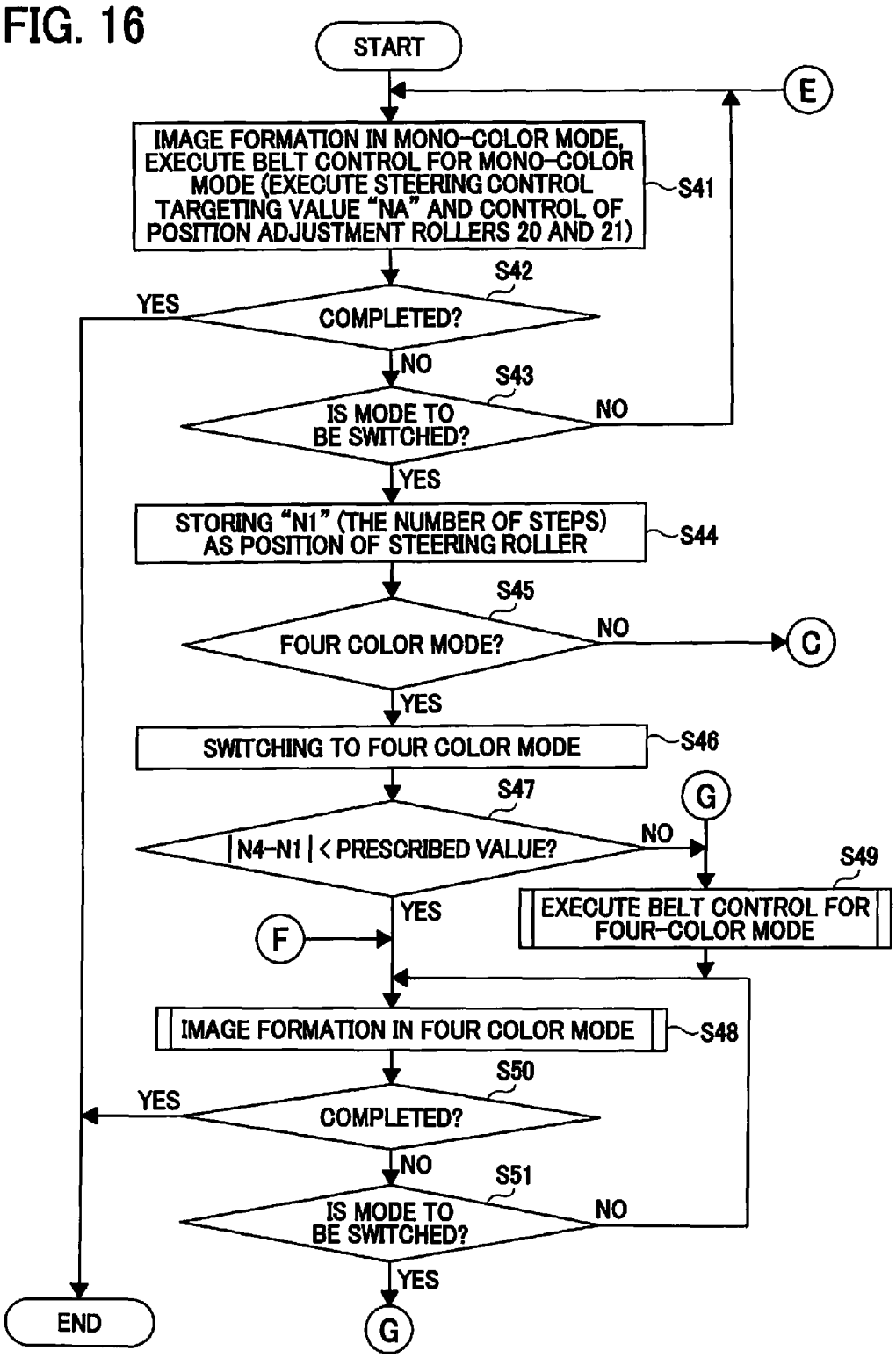
FIG. 16 is a flowchart illustrating a process of the main routine until halfway thereof pursued by the control unit when image formation is started in a monochromatic mode according to the second embodiment of the present invention.
Figure 17:
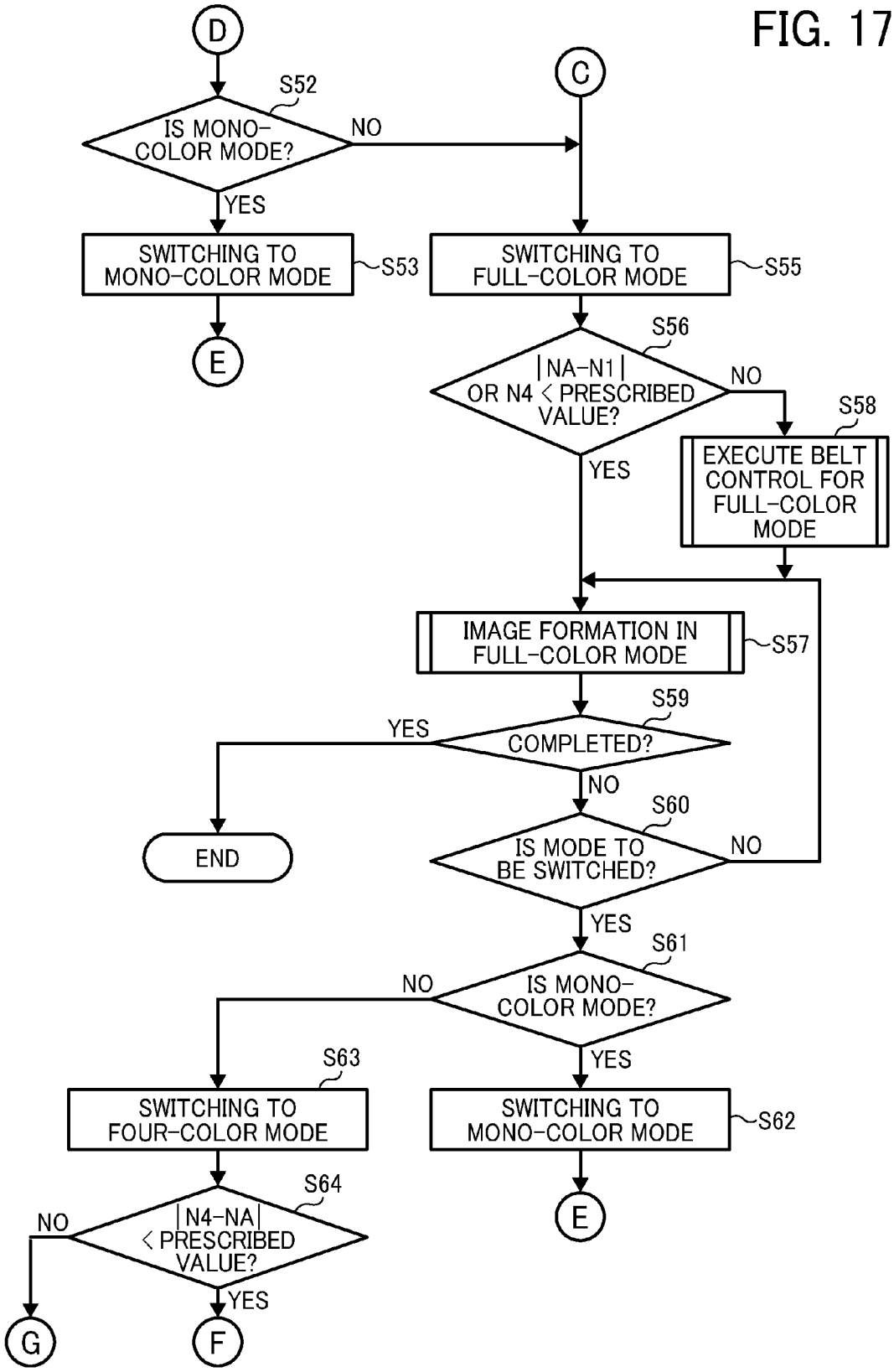
FIG. 17 is a flowchart illustrating a sequence executed subsequent to that of FIG. 16.

Now, a situation when image formation is started in a monochromatic mode is described. When image formation is started in the monochromatic mode as shown in FIG. 14, a process shown in FIGS. 16 and 17 is started. Subsequently, since a monochromatic mode does not raise a problem of color displacement, image formation is immediately executed in the monochromatic mode, while the "belt control in a monochromatic mode" is executed in parallel thereto in step S41 of FIG. 16.

While the "monochromatic mode belt control" controls both the position adjustment rollers 20 and 21 while conducting the steering control for the intermediate transfer belt 1 targeting the stable position NA (the number of rotation steps rotating the steering motor 41 from the initial position) stored in the previous belt control in the all-color mode. Hence, a position of the intermediate transfer belt 1 in its widthwise direction is adjusted and stabilized near the reference position while keeping the inclination position of the steering roller 3 at the stable position defined in the last all-color mode. However, if the "all-color mode belt control" has not yet executed and the stable position NA has not been stored, a default value NAd of the number of rotation steps of the steering motor 41 stored in the memory 38 beforehand as the optimum value for all-color mode on the design is targeted in executing the steering control.

When the image formation process for an amount of a sheet is completed in step S41, it is determined if image formation is terminated (i.e., data to form an image is missing) in step S42. When it is determined to be terminated, processing of the main routine is terminated. By contrast, when the determination is negative (i.e., No) in step S42, it is further determined whether modes are to be switched in step S43. When the modes are not to be switched, the process returns to step S41, and the image formation and the belt control are repeated in the monochromatic mode.

By contrast, when it is determined that modes are to be switched in step S44, the number (e.g. a positive or negative integer) of rotation steps rotating the steering motor 41 from the initial position equivalent to an inclination of the steering roller 3 at that time is stored in the memory 38 as a value N1 defined right before switching of the modes in step S44. When a target value is already established in the steering control at that time, the value N1 defined right before switching of the modes should be equal to the stable position NA defined in the previous all-color mode.

Further, it is determined if a switching mode is a four-color mode in step S45. If it is the four-color mode, the current mode is switched to the four-color mode as shown in FIG. 13 in step S46. Further, it is determined whether a difference |N4−N1| is less than a given value in step S47, wherein N1 represents the above-described value obtained right before mode switching, and N4 represents the stable position of the steering roller 3 stored in belt control executed in the four-color mode.

If the difference (an absolute value) between N4 and N1 is less than a predetermined value, since an amount of inclination of the steering roller 3 to be changed due to mode switching is small, the process goes to step S48, and image formation is performed in the four-color mode. The determination of whether or not "less than predetermined value" can be whether or not "equal to or less than predetermined value" (hereinafter the same), and the same goes hereinafter in a determination step determining the difference from the stable position of the steering roller 3 after switching of the modes. The prescribed value is substantially the same as in the above-described embodiments.

By contrast, when the determination in step S47 is negative (i.e., No), since the amount of inclination of the steering roller 3 to be changed due to mode switching increases, the process returns back to step S49 and the belt control in the four-color mode is executed as shown in FIG. 22, and after that the image formation in the four-color mode is executed in step S48. Since the stable position N4 is not stored at the beginning of the process, and accordingly the difference |N4−N1| never becomes less than the given value, the determination in step S47 is negative (i.e., No) and the "belt control in the four-color mode" as shown in FIG. 22 is executed in step S44.

Specifically, as shown in FIG. 22, the "four-color mode belt control", starts with "belt driving", "steering control (targeting the value NA)", and "control of the position adjustment roller 21" in step S201, and reads a detected value Ps of the belt edge sensor 13 in step S202 to determine if the detected value Ps meets a prescribed condition in step S203. The prescribed condition means that the detected value Ps continuously falls within a predetermined range of a reference position (i.e., a reference position±Δ) over a given time. The position adjustment roller 21 is controlled in accordance with the difference between the reference position and the detected value Ps in step S204 until the detected value Ps meets the prescribed condition while repeating the processes in steps S202 to S204.

When the prescribed condition is met in step S203, the number of steps rotating the steering motor 41 from the initial position until that time is stored as the stable position NA of the inclination of the steering roller 3 in the memory 38 in step S205. Subsequently, the process returns to the main routine of FIG. 16. At this time, N4 mostly becomes almost the same as NA.

Subsequently, image formation is performed in the four-color mode in step S48 of FIG. 16. When the image formation process for an amount of a sheet is completed, it is determined if image formation is terminated in step S50. When it is determined to be terminated, processing of the main routine is terminated. By contrast, when the determination is negative (i.e., No) in step S50, it is further determined whether modes are to be switched in step S51. When the modes are not to be switched, the process returns to step S48, and the image formation in the four-color mode is repeated.

By contrast, when it is determined in step S51 that the modes are to be switched, the process goes to step S52 of FIG. 17, and it is determined if the switching mode is a monochromatic mode. If the switching mode is the monochromatic mode, the current mode is switched to the monochromatic mode of FIG. 14 in step S53. Then, the process returns to step S41 of FIG. 16 and the image formation and the belt control in the monochromatic mode are executed in parallel.

Further, when it is determined that a switching mode is not in the four-color mode in step S45 of FIG. 16 nor the monochromatic mode in step S52 of FIG. 17, the process goes to step S55 in FIG. 17 and the current mode is switched to the all-color mode as shown in FIG. 12. It is then determined whether a difference |NA−N1 or N4| is less than a given value in step S56, wherein Na represents a stable position of the steering roller 3 stored in the last "all-color mode belt control", N1 represents a value defined right before mode switching stored in step S44, and N4 represents a stable position of inclination of the steering roller 3 stored in belt control executed in a four-color mode in step S49.

Further, if the determination in step S56 is positive (i.e., Yes), i.e., the difference between the NA and N1 or N4 is less than a predetermined value, since an amount of inclination of the steering roller 3 to be change due to switching of the modes is relatively small, the process goes to step S57 and image formation can be performed in the all-color mode. Since, these N1 and N4 are usually almost the same value with NA, |NA−N1 or N4| becomes less than a given value, and the process can immediately go to step S57 to perform image formation in the all-color mode.

However, when the determination is negative (i.e., No) in step S56, since an amount of inclination of the steering roller 3 to be changed due to mode switching increases, the process goes to step S58 and executes the belt control in the all-color mode, and after that the image formation in the all-color mode is executed in step S57. Since the stable value NA has not been stored in an all-color mode at the beginning of the process, and accordingly the difference |NA−N1 or N4| never becomes less than the given value, the "belt control in the all-color mode" is executed in step S58. The "belt control in all-color mode" is similar to that in the first embodiment as shown in FIG. 11. In such a situation, the position adjustment rollers 20 and 21 do not provide the above-described belt control.

Subsequently, image formation is performed in the all-color mode in step S57 of FIG. 17. When the image formation process for an amount of a sheet is completed, it is determined if image formation is terminated in step S59. When it is determined to be terminated, processing of the main routine is terminated. By contrast, when the determination is negative (i.e., No) in step S59, it is further determined whether modes are to be switched in step S60. When the modes are not to be switched, the process returns to step S57 and the image formation in the all-color mode is repeated.

Further, when it is determined in step S60 that the modes are to be switched, the process goes to step S61, and it is determined if the switching mode is a monochromatic mode. If the switching mode is the monochromatic mode, the current mode is switched to the monochromatic mode of FIG. 14 in step S62. Then, the process returns to step S41 of FIG. 16 and the image formation and the belt control in the monochromatic mode are executed in parallel. However, if the determination of the step S61 is negative (i.e., No), the process goes to step S63 and the current mode is switched to the four-color mode as shown in FIG. 13.

Then, it is determined whether a difference |N4−NA| is less than a given value in step S64, wherein N4 and NA are stable positions of the steering roller 3 stored in the "four-color mode belt control" executed in step S49 and the all-color mode belt control executed in step S58, respectively. If the difference between NA and N1 is determined to be less than a predetermined value in step S64, since an amount of inclination of the steering roller 3 to be changed due to switching of the modes is relatively small, the process goes back to step S48 as is and the image formation is performed in the all-color mode. Usually, in most cases, N4 is almost the same as the NA, the |N4−NA| becomes less than a given value in step S64, and image formation of in the all-color mode can be immediately started going back to step 48.

However, when the determination is negative (i.e., No) in step S64, since an amount of inclination of the steering roller 3 to be changed due to switching of the modes increases, the process returns back to step S49 of FIG. 16 and the belt control in the four-color mode (FIG. 22) is executed, and after that the image formation in the four-color mode is executed in step S48. Subsequently, the above-described processes are repeated until it is determined that the process is completed in one of steps S43, S50, and S59.

Figure 18:
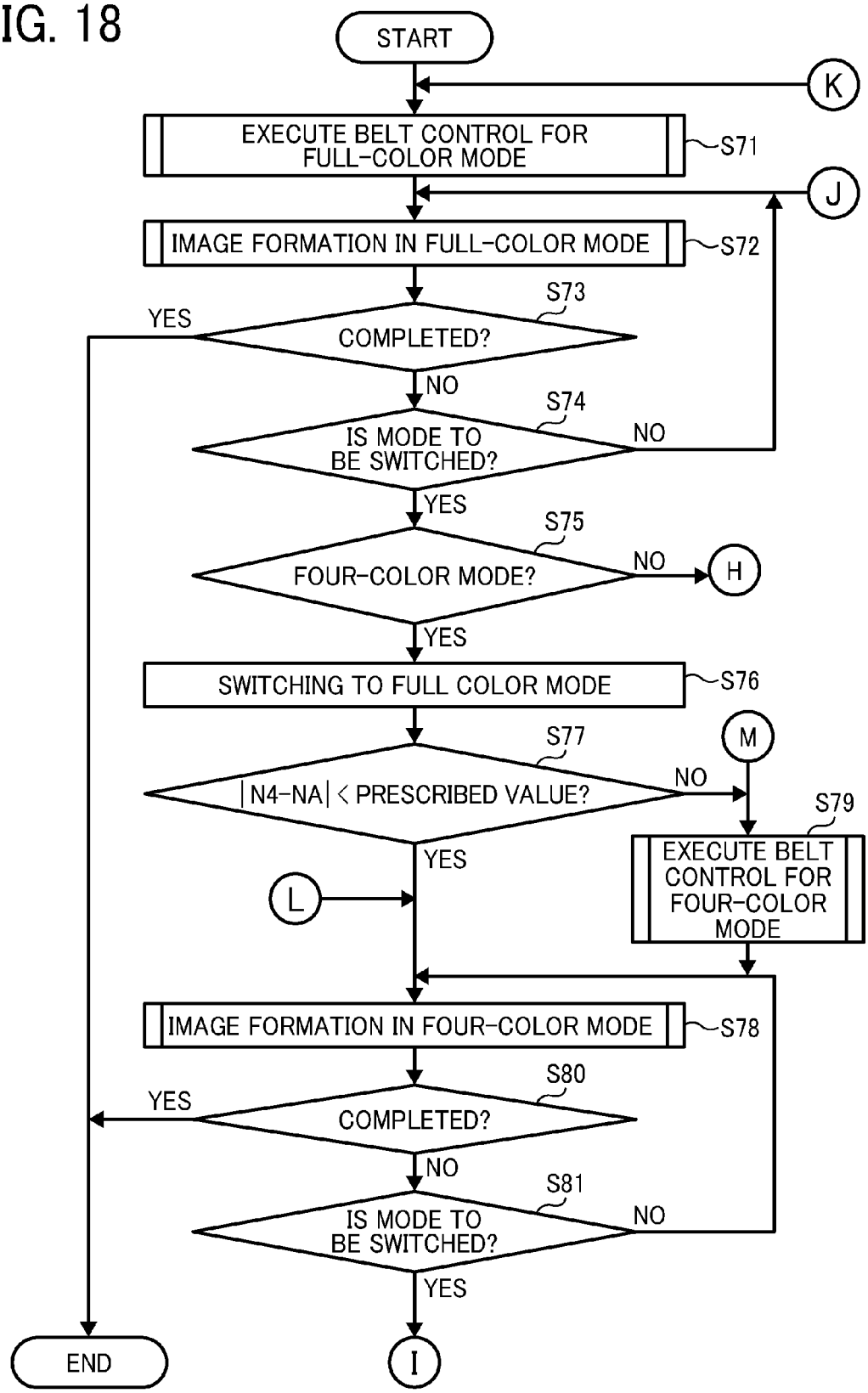
FIG. 18 is a flowchart of a process executed in the main routine until halfway thereof pursued by the control unit when image formation is started in an all-color mode.
Figure 19:
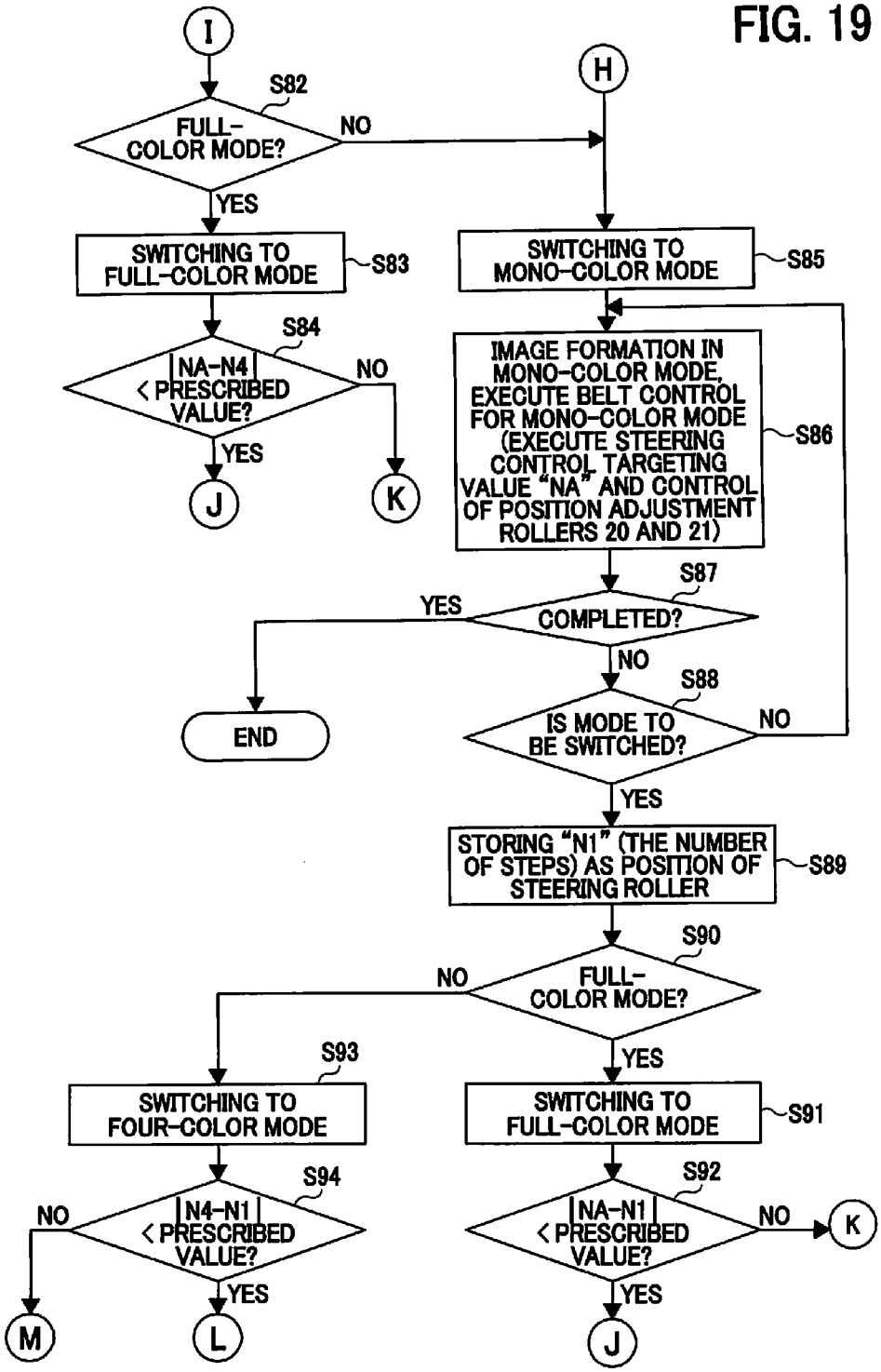
FIG. 19 is a flowchart illustrating a sequence executed subsequent to that of FIG. 18.

Now, a situation when image formation is started in an all-color mode is described. When image formation is started in the all-color mode as shown in FIG. 12, a process shown in FIGS. 18 and 19 is started. Specifically, "belt control in an all-color mode" is initially executed in step S71 in FIG. 18 similar to the above-described system of FIG. 11. Subsequently, image formation is executed in the all-color mode.

Subsequently, image formation is performed in the all-color mode in step S72. When the image formation process for an amount of a sheet is completed, it is determined if image formation is terminated in step S73. When it is determined to be terminated, processing of the main routine is terminated. By contrast, when the determination is negative (i.e., No) in step S73, it is further determined whether modes are to be switched in step S74. When the modes are not to be switched, the process returns to step S72 and the image formation in the all-color mode is repeated.

Further, when it is determined in step S74 that the modes are to be switched, the process goes to step S75, and it is determined if a switching mode is a four-color mode. If the switching mode is the four-color mode, the current mode is switched to the four-color mode as shown in FIG. 13 in step S76. Then, it is determined whether a difference |N4-NA| is less than a given value in step S77. If the difference between the NA and N1 is less than a predetermined value, the process goes to step S78 as is, and the image formation is performed in the four-color mode. Usually, in most cases, N4 is almost the same as the NA, image formation in the four-color mode can be immediately started.

However, if the determination of the step S77 is negative (i.e., No), the belt control in the four-color mode (FIG. 22) is executed in step S79, and after that the image formation in the four-color mode is executed in step S78. Since the stable position N4 is not stored at the beginning of the process, and accordingly the difference |N4−NA| never becomes less than the given value, the determination in step S77 is negative (i.e., No) and the "belt control in the four-color mode" is executed in step S79, and a stable position N4 of the steering roller 33 is stored.

Then, the image formation in the four-color mode is executed in step S78. When the image formation process for an amount of a sheet is completed, it is determined if image formation is terminated in step S80. When it is determined to be terminated, processing in the main routine is terminated. By contrast, if the determination is negative (i.e., No) in step S80, it is further determined whether modes are to be switched in step S81. When the modes are not to be switched, the process returns to step S78, and the image formation is repeated in the four-color mode.

Further, when it is determined in step S81 that the modes are to be switched, the process goes to step S82 of FIG. 19, and it is determined if a switching mode is an all-color mode. If the switching mode is the all-color mode, the current mode is switched to the all-color mode of FIG. 12 in step S83. Further, it is determined whether a difference |NA−N41 is less than a given value in step S84, wherein N4 and NA are stable positions of the steering roller 3 stored in the "all-color mode belt control" executed in step S71 and the "four-color mode belt control" executed in step S79, respectively.

Since, in most cases, N4 is almost the same as the NA usually, and the difference |NA−N4| is less than a given value, and accordingly an amount of inclination of the steering roller 3 to be changed due to switching of the modes is relatively small, image formation in the all-color mode is started as is retuning back to step S72 of FIG. 18. However, if the determination of the step S84 is negative (i.e., No), since the amount of in inclination of the steering roller 3 to be changed due to switching of the modes increases, the process returns to step S71 and the belt control in the all-color mode (FIG. 11) is executed, and after that the image formation in the all-color mode is executed in step S72.

Further, when it is determined that the switching mode is not the four-color mode in step S75 of FIG. 18 nor the all-color mode in step S82 of FIG. 19, the process goes to step S85 in FIG. 19 and the current mode is switched to the monochromatic mode as shown in FIG. 14. Subsequently, image formation is executed in the monochromatic mode, and the "belt control in the monochromatic mode" similarly executed in step S41 is executed in parallel in step S86.

When the image formation process for an amount of a sheet is completed, it is determined if image formation is terminated in step S87. When it is determined to be terminated, processing in the main routine is terminated. By contrast, when the determination is negative (i.e., No) in step S87, it is further determined whether modes are to be switched in step S88. When the modes are not to be switched, the process returns to step S86, and the image formation and the belt control in the monochromatic mode are repeated.

Further, when it is determined that modes are to be switched in step S88, the number (e.g. a positive or negative integer) of rotation steps rotating the steering motor 41 from the initial position equivalent to an inclination of the steering roller 3 at that time is stored in the memory 38 as a value N1 defined right before switching of the modes in step S89. When a target value for steering control is already met at that time, the value N1 defined right before the switching should be equal to the stable position NA defined in the last all-color mode.

Subsequently, it is determined in step S90 if the switching mode is an all-color mode.

If the switching mode is the all-color mode, the current mode is switched to the all-color mode shown in FIG. 12 in step S91. Then, it is further determined whether a difference |NA−Nil is less than a given value in step S92. If the difference between the NA and N1 is less than such a predetermined value, the process goes to step S72 of FIG. 18 as is, and the image formation is performed in the all-color mode. Since, in most cases, N4 is almost the same as the NA usually as described above, image formation in the all-color mode can be immediately started after the current mode is switched to the all-color mode.

However, if the determination in step S93 is negative (i.e., No), since an amount of inclination of the steering roller 3 to be hanged due to switching of the modes increases, the process returns to step S71 and the belt control in the all-color mode (FIG. 11) is executed, and after that the image formation in the all-color mode is executed in step S72 of FIG. 18. By contrast, if it is determined that the switching mode is not the all-color mode in step S90, the process goes to step S93, and the current mode is switched to the four-color mode shown in FIG. 13.

Then, it is determined whether a difference |N4−N1| is less than a given value in step S94, wherein N4 and N1 are the stable positions of the steering roller 3 stored in the "four-color mode belt control" in step S79 and the value thereof defined right before switching of the modes and stored in step S89, respectively. If the difference between the N4 and N1 is less than a predetermined value, the process goes back to step S78 of FIG. 18 and the image formation is performed in the four-color mode. Since N4 is almost the same with the NA usually, and N1 is almost the same with the NA, and accordingly the N4 is almost the same as the N1, the difference |N4−N1| becomes less than the given value. Accordingly, image formation in the four-color mode is immediately started after switching thereto.

However, when the determination is negative (i.e., No) in step S94, since an amount of inclination of the steering roller 3 to be changed due to switching of the modes increases, the process returns back to step S79 of FIG. 18 and the belt control in the four-color mode (FIG. 22) is executed, and after that the image formation in the four-color mode is executed in step S78. Subsequently, the above-described processes are repeated until it is determined that the process is completed in one of steps S73, S80, and S87.

Figure 20:
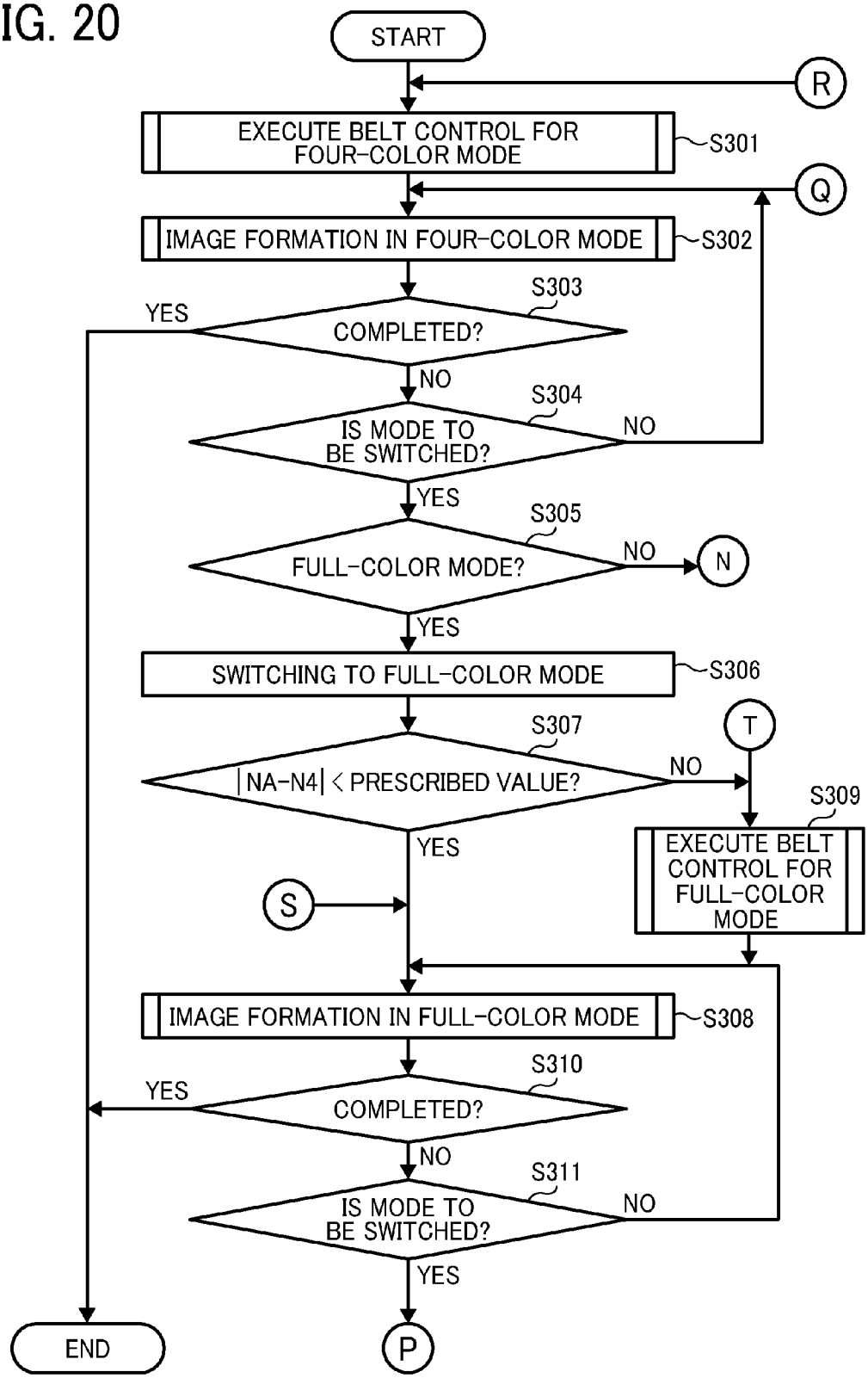
FIG. 20 is a flowchart illustrating a process executed in the main routine until halfway thereof by the control unit when image formation is started in a four-color mode.
Figure 21:
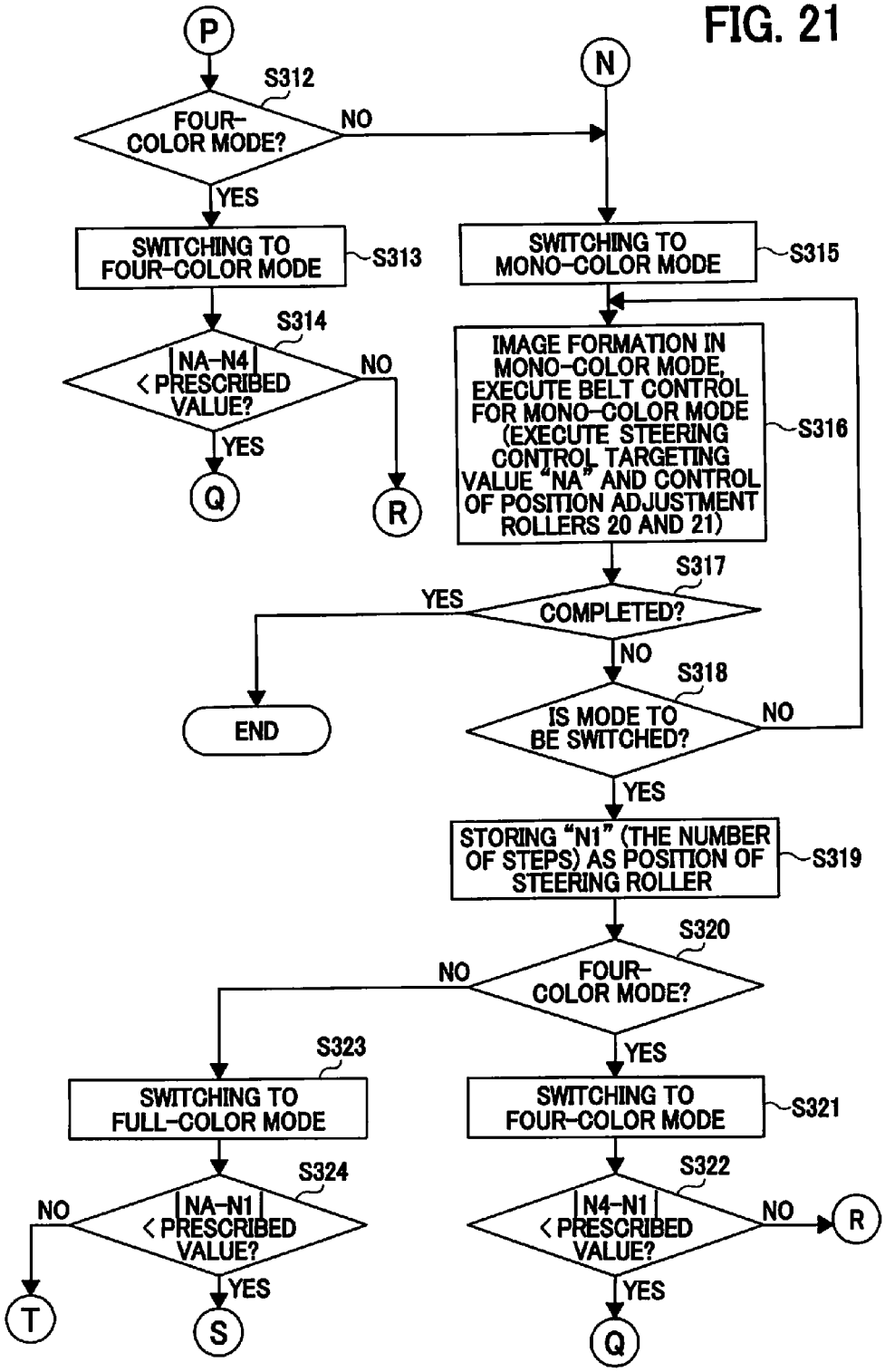
FIG. 21 is a flowchart illustrating a sequence executed subsequent to that of FIG. 20.

Now, a situation when image formation is started in a four-color mode is described. When image formation is started in the four-color mode shown in FIG. 13, a process shown in FIGS. 20 and 21 is started. Then, the "belt control in a four-color mode" shown in FIG. 20 is initially executed in step S301 of FIG. 20. By conducting the steering control targeting the stable position NA (a default value NAd when NA is not yet stored), the position adjustment roller 21 is controlled in parallel. When a detected value Ps of the belt edge sensor 13 satisfies a given condition, the number of steps rotating the steering motor 41 from the initial position until that time is stored as a stable position N4 of the steering roller 3.

Subsequently, image formation is performed in the four-color mode in step S302 of FIG. 20. When the image formation process for an amount of a sheet is completed, it is determined if image formation is terminated in step S303. When it is determined to be terminated, processing of the main routine is terminated. By contrast, when the determination is negative (i.e., No) in step S303, it is further determined whether modes are to be switched in step S304. When the modes are not to be switched, the process returns to step S302, and the image formation in the four-color mode is repeated.

By contrast, when it is determined in step S304 that the modes are to be switched, the process goes to step S305 and it is determined if a switching mode is an all-color mode. If the switching mode is the all-color mode, the current mode is switched to the all-color mode of FIG. 12 in step S306. Then, it is determined whether a difference |NA−N41 is less than a given value in step S307, wherein NA and N4 are the stable positions of the steering roller 3 stored in the "all-color mode belt control" and the "four-color mode belt control" in step S301, respectively. If the difference between NA and N4 is less than such a predetermined value, the process goes to step S308 as is, and the image formation is performed in the all-color mode.

However, when the determination is negative (i.e., No) in step S307, the process goes to step S309 and the belt control in the all-color mode is executed, and after that the image formation in the all-color mode is executed in step S308. Since the stable position NA is not stored at the beginning of the process, and accordingly the difference |NA−N4| is not less than the given value, the determination becomes negative (i.e., No) in step S307, so that the belt control in the all-color mode shown in FIG. 11 is executed in step S309. When the detected value Ps of the belt edge sensor 13 meets the predetermined condition, the number of steps rotating the steering motor 41 from the initial position until that time is stored as the stable position NA of the inclination of the steering roller 3.

Subsequently, image formation is performed in the all-color mode in step S308. When the image formation process for an amount of a sheet is completed, it is determined if image formation is terminated in step S310. When it is determined to be terminated, processing of the main routine is terminated. By contrast, when the determination is negative (i.e., No) in step S310, it is further determined whether modes are to be switched in step S311. When the modes are not to be switched, the process returns to step S308, and the image formation in the all-color mode is repeated.

By contrast, when it is determined in step S311 that the modes are to be switched, the process goes to step S312 of FIG. 21, and it is determined if a switching mode is a four-color mode. If the switching mode is the four-color mode, the current mode is switched to the four-color mode of FIG. 13 in step S313. Then, it is determined whether a difference |N4-NA| is less than a given value in step S314. If the difference between the NA and N4 is less than such a predetermined value, the process returns to step S302 of FIG. 21 and the image formation is performed in the four-color mode.

Since, in most cases, N4 is almost the same as the NA usually, image formation in the four-color mode can be immediately started without a waiting time. However, if the determination of the step S314 is negative (i.e., No), since an amount of inclination of the steering roller 3 to be changed due to switching of the modes increases, the process returns to step S301 of FIG. 20 and the belt control in the four-color mode (FIG. 22) is executed, and after that the image formation in the four-color mode is executed in step S302.

Further, when it is determined that a switching mode is not the all-color mode in step S305 of FIG. 20 nor the four-color mode in step S312 of FIG. 21, the process goes to step S315 in FIG. 21 and the current mode is switched to the monochromatic mode shown in FIG. 14. Subsequently, image formation is started in the monochromatic mode in step S316, and the "belt control in a monochromatic mode" similarly executed in steps S41 and S86 is executed in parallel.

When the image formation process for an amount of a sheet in step S316 is completed, it is determined if image formation is terminated in step S317. When it is determined to be terminated, processing of the main routine is terminated. By contrast, when the determination is negative (i.e., No) in step S317, it is further determined whether modes are to be switched in step S318. When the modes are not to be switched, the process returns to step S316, and the image formation and the belt control in the monochromatic mode are repeated.

Further, when it is determined that modes are to be switched in step S318, the number (e.g. a positive or negative integer) of rotation steps rotating the steering motor 41 from the initial position equivalent to an inclination of the steering roller 3 at that time is stored in the memory 38 as a value N1 defined right before switching of the modes in step S319. When a target value for steering control is already met at that time, the value N1 defined right before switching of the modes should be equal to the stable position NA defined in the previous all-color mode. Subsequently, it is determined if a switching mode is a four-color mode in step S320.

If it is the four-color mode, the current mode is switched to the four-color mode as shown in FIG. 13 in step S321. Then, it is determined whether a difference |N4−N1| is less than a given value in step S322. If the difference between the NA and N1 is less than such a predetermined value, the process returns to step S302 as is, and the image formation is performed in the four-color mode.

Usually, in most cases, N4 is almost the same as the NA, and N1 is almost the same as the NA, and accordingly, the N4 is almost the same as the N1. Thus, a difference |N4−N1| is less than the given value, so that image formation in the four-color mode can be immediately started after switching thereto. However, when the determination is negative (i.e., No) in step S322, the process returns back to step S301 of FIG. 20, and the belt control in the four-color mode (FIG. 22) is executed, and after that the image formation in the four-color mode is executed in step S302.

By contrast, if it is determined that a switching mode is not the all-color mode in step S320, the process goes to step S323, and the current mode is switched to the all-color mode shown in FIG. 12. Then, it is determined whether a difference |N4−N1| is less than a given value in step S324. If the difference between the N4 and N1 is less than such a predetermined value, the process goes back to step S308 of FIG. 20 and the image formation is performed in the all-color mode.

Since, in most cases, N1 is almost the same as the NA, the difference |NA−N1| becomes less than the given value. Accordingly, image formation in the all-color mode can be immediately started after switching thereto. However, when the determination is negative (i.e., No) in step S324, the process returns to step S309 of FIG. 20 and the belt control in the all-color mode (FIG. 11) is executed, and after that the image formation in the four-color mode is executed in step S308. Subsequently, the above-described processes are repeated until it is determined that the process is completed in one of steps S303, S310, and S317.

Also in this embodiment, a difference between the stable position NA or N4 of the steering roller 3 before and after mode switching to all-color or four-color mode and that between NA or N4 and N1 defined right before switching of the modes from the monochromatic mode, stored in the memory 38, is less than or below a predetermined value, image formation of the all-color mode or the four-color mode can be immediately started after switching thereto without a waiting time.

In addition, since the steering control is performed in the belt control process in each of the four-color and monochromatic modes targeting the stable position NA of the steering roller 3 defined in the last all-color mode, both the stable position of the N4 defined in the belt control executed in the four-color mode and the value N1 defined right before switching of the modes from a monochromatic mode are almost equal to the stable position NA defined in the last all-color mode in most cases. As a result, image formation in the all-color or four-color modes can be frequently started immediately after switching thereto. Further, when the current mode is switched to the monochromatic mode, image formation can be always immediately started in the monochromatic mode.

Further, also in this embodiment, when color displacement on an image is not strictly inhibited, determination about a difference from either the stable position of the steering roller 3 or the value defined immediately before switching of the modes can be omitted even if a current mode is switched to the all-color mode or the four-color mode. Consequently, image formation can be immediately started in a switched mode without a waiting time. Further, in such a situation, the belt control in the all-color mode or the four-color mode can be executed in parallel to such image formation.

Further, in each of the various embodiments, displacement of the belt can be adjusted using the position adjustment roller 20 or position adjustment rollers 20 and 21 in the belt control process in the monochromatic mode and the four-color mode. Therefore, the stable position of the steering roller 3 can be almost the same (the stable position NA in the all-color mode) in each of the image formation modes. Accordingly, an abrupt change in displacement caused immediately after switching of the modes can be reduced, and a change in inclination of the steering roller 3 disappears at the same time. Further, image formation can be immediately started after switching the current mode without a waiting time.

Figure 23:
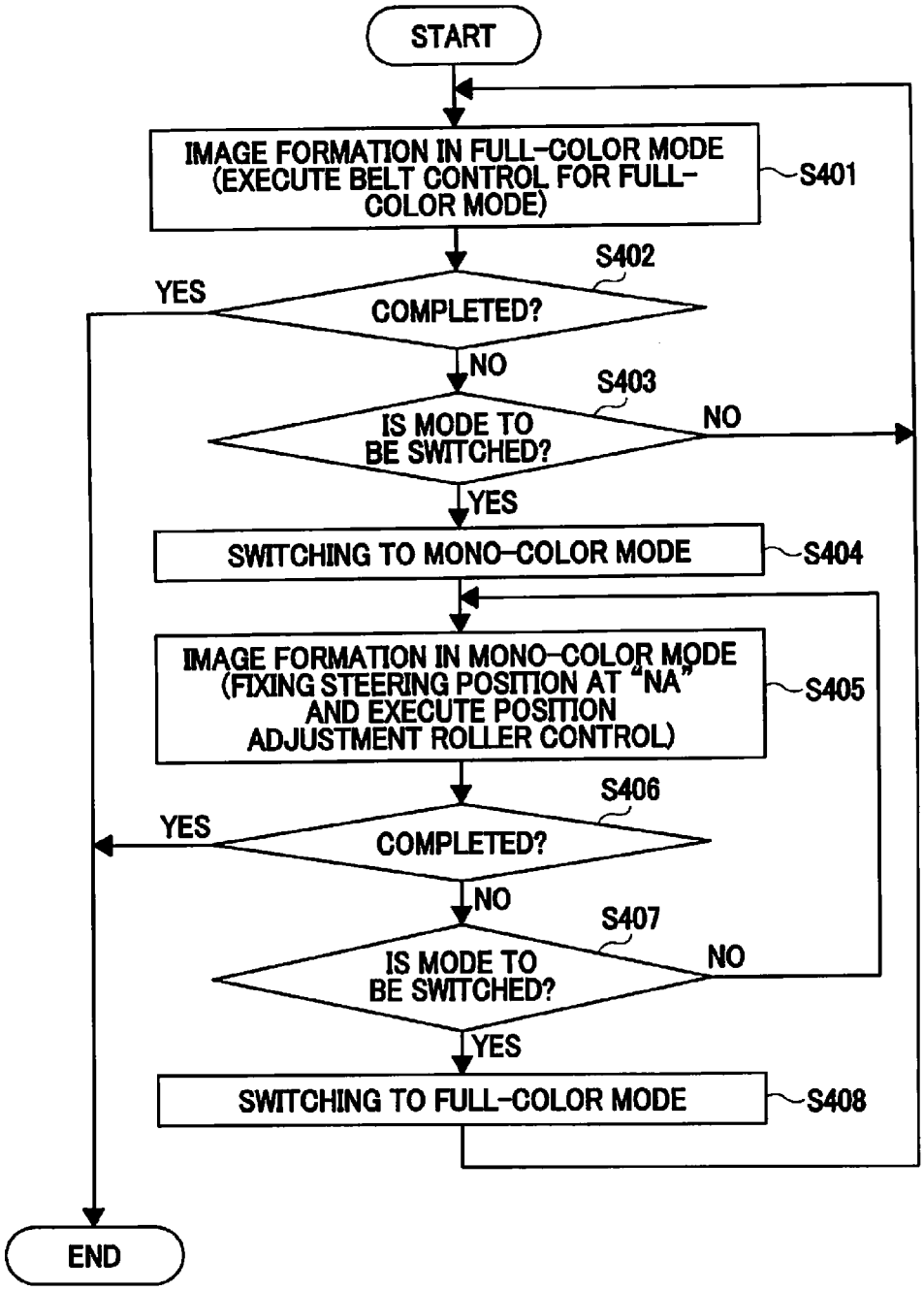
FIG. 23 is a flowchart illustrating a process executed by the control unit when image formation is started in the all-color mode according to a third embodiment of the present invention.
Figure 24:
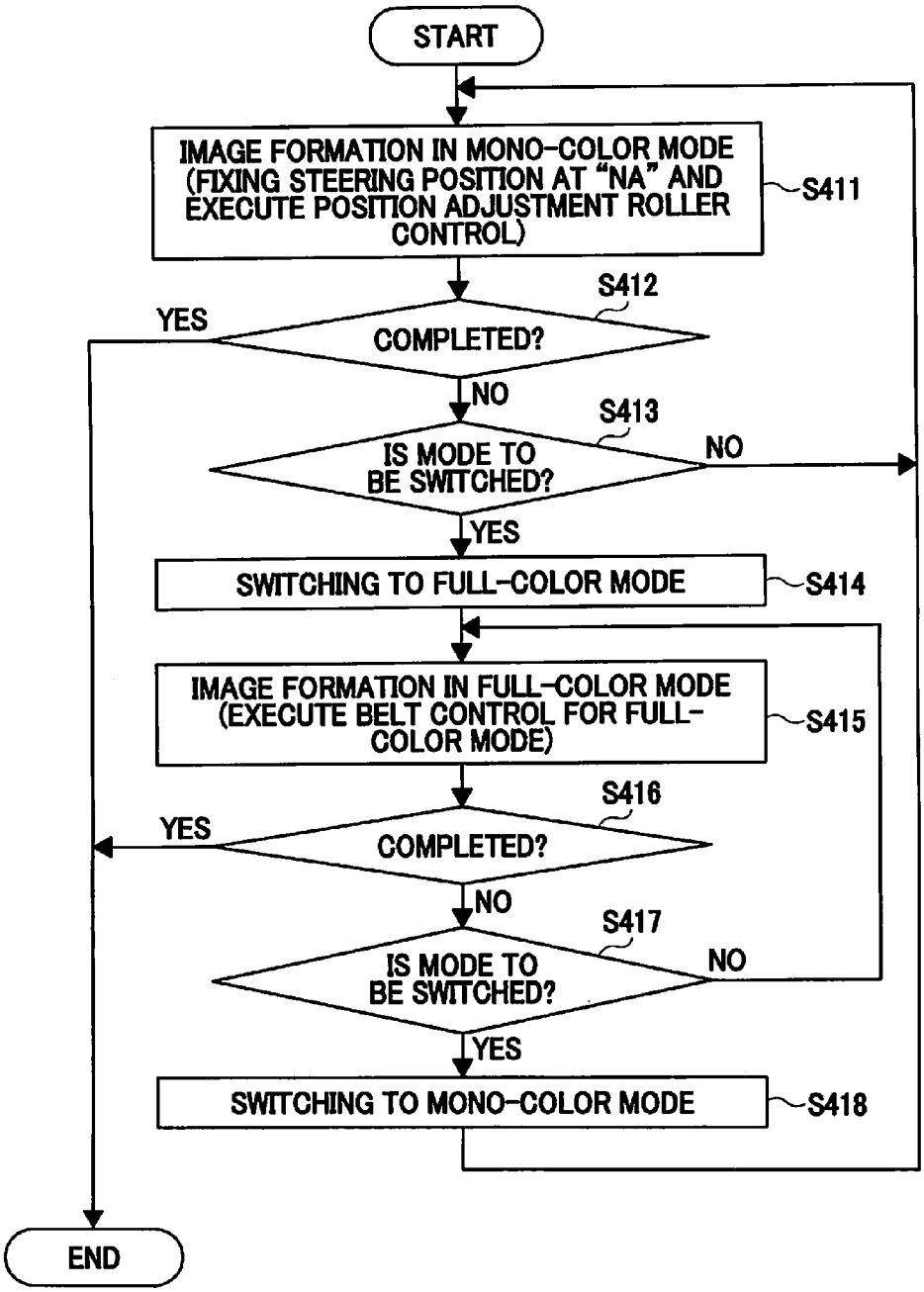
FIG. 24 is a flowchart illustrating a process executed by the control unit when image formation is started in the monochromatic mode.

Now, a third embodiment of present invention that simplifies belt control of an image forming apparatus is described mainly with reference to FIGS. 23 and 24. A configuration of the image forming apparatus of the third embodiment is the same as that of the first embodiment shown in FIG. 1. Further, various aspects of contactable rollers on the intermediate transfer belt 1 in all-color and monochromatic modes in the image forming apparatus of FIG. 1 are the same as those in FIGS. 6 and 7. Further, a configuration of a control unit and relevant part thereto in the image forming apparatus is also the same as those shown in a block chart of FIG. 8.

Initially, a situation when image formation is started in an all-color mode is described. When image formation is started in the all-color mode (i.e., a full-color mode) shown in FIG. 6, a process shown in FIG. 23 is started. Specifically, in step S401, image formation in the all-color mode and the same "belt control in an all-color mode" as employed in the first embodiment of FIG. 11 are executed in parallel.

At this moment, if a stable position NA of the steering roller 3 is already defined in the last all-color mode and is stored, steering control is started targeting the stable position NA for the steering roller 3 while circulating the intermediate transfer belt 1. However, since the stable position NA is not stored at the beginning of the process, the steering control is started targeting a prescribed default value NAd stored in a memory 38 of FIG. 8 as an inclined position of the steering roller 3.

Subsequently, the process shown in FIG. 11 is executed. When the detected value Ps of the belt edge sensor 13 meets a predetermined condition, the number of steps (e.g. a positive or negative integer) rotating the steering motor 41 from the initial position until that time is stored in the memory 38 of FIG. 8 as a new stable position NA of the steering roller 3. When image formation for a single sheet is completed in the middle of the belt control, the process proceeds to step S402. However, until it is determined that modes are to be switched in the next step S403, the belt control continues. Further, when the stable position NA of the steering roller 3 is once stored, the belt control is continued to retain such a condition.

When the image formation process for an amount of a sheet is completed, it is determined if image formation is terminated (i.e., data to form an image is missing) in step S402. When it is determined to be terminated, processing of the main routine is terminated. By contrast, when the determination is negative (i.e., No) in step S402, it is further determined whether modes are to be switched in step S403. When the modes are not to be switched, the process returns to step S401, and the image formation and the belt control are repeated in the all-color mode.

Further, when it is determined in step S403 that the modes are to be switched, a current mode is switched to a monochromatic mode as shown in FIG. 7 in step S404. Then, the image formation is immediately started in the monochromatic mode and belt control is executed in parallel thereto in step S405. Such belt control is executed by controlling an inclination of the position adjustment roller 20 while fixing an inclining position of the steering roller 3 to the stable position NA defined in the all-color mode and circulating the intermediate transfer belt 1 so that a detected value Ps of the belt edge sensor 13 is stabilized at around a reference position.

In step 405, when the image formation process for an amount of a sheet is completed, it is determined if image formation is to be terminated (i.e., data to form an image is missing) in step S406. When it is determined to be terminated, processing of the main routine is terminated. By contrast, when the determination is negative (i.e., No) in step S406, it is further determined whether modes are to be switched in step S407. When the modes are not to be switched, the process returns to step S405, and the image formation and the above-described belt control are repeated in the monochromatic color mode. Further, when it is determined in step S407 that the modes are to be switched, the current mode is switched to the all-color mode in step S408.

Then, the process returns to step S401, and the image formation is started and the above-described belt control are executed in the all-color mode. Subsequently, the above-described processes are repeated until it is determined that the process is completed in one of steps S403 and S406.

Now, a situation when image formation is started in a monochromatic mode is described. When image formation is started in the monochromatic mode as shown in FIG. 7, a process shown in FIG. 24 is started. Specifically, in step S411, the image formation in the all-color mode while the "belt control in the monochromatic mode" are executed in parallel.

In the belt control, if the stable position NA of the steering roller 3 in the all-color mode is stored, the intermediate transfer belt 1 is adjusted by rendering an inclined position of the steering roller 3 is fixed to the stable position NA and the inclination of the position adjustment roller 20 is controlled while circulating the intermediate transfer belt 1 so that a detected value Ps of the belt edge sensor 13 is stabilized at around a reference position. However, since the stable position NA is not stored at the beginning of the process, a prescribed default value NAd stored in the memory 38 of FIG. 8 is assigned to an inclined position (as a target) of the steering roller 3, and the inclination of the position adjustment roller 20 is controlled while circulating the intermediate transfer belt.

In step S411, when the image formation process for an amount of a sheet is completed, it is determined if image formation is to be terminated in step S412. When it is determined to be terminated, processing of the main routine is terminated. By contrast, when the determination is negative (i.e., No) in step S412, it is further determined whether modes are to be switched in step S413. When the modes are not to be switched, the process returns to step S411, and the image formation and the above-described belt control are repeated in the monochromatic mode.

By contrast, when it is determined in step S413 that the modes are to be switched, the current mode is switched to the all-color mode shown in FIG. 6 in step S414. Then, the image formation is started and belt control therefor is executed in parallel thereto in the all-color mode in step S415 in step S401. At this moment, if a stable position NA of the steering roller 3 defined in the last all-color mode is stored, the stable position NA is assigned to an inclined position (as a target) of the steering roller 3 and steering control is started.

However, since the stable position NA is not stored at the beginning, with an inclined position of the steering roller 3 being a prescribed default value NAd stored in the memory 38 of FIG. 8, the steering control is started. Further, since an inclined position of the steering roller 3 when the modes are switched is almost the same as the stable position NA or the default value NAd, the steering control can be started from a current condition.

Subsequently, the similar process as shown in FIG. 11 is executed. When the detected value Ps of the belt edge sensor 13 meets a predetermined condition, the number of steps (e.g. a positive or negative integer) rotating the steering motor 41 from the initial position until that time is stored as a new stable position NA of the inclination of the steering roller 3 in the memory 38 illustrated in FIG. 8. Subsequently, the belt control is continued to retain such a condition.

Subsequently, the similar process as shown in FIG. 11 is executed. When the detected value Ps of the belt edge sensor 13 meets a predetermined condition, the number of steps (e.g. a positive or negative integer) rotating the steering motor 41 from the initial position until that time is stored as a new stable position NA of the inclination of the steering roller 3 in the memory 38 illustrated in FIG. 8. Subsequently, the belt control is continued to retain such a condition.

By contrast, when it is determined in step S417 that the modes are to be switched, the current mode is switched to the monochromatic mode as shown in FIG. 7 in step S418. Subsequently, the process returns to step S411, and the image formation is started and belt control therefor are executed in parallel in the monochromatic mode. In step S411 of the second and more cycles, an inclined position (as a target) of the steering roller 3 is fixed to the stable position NA defined in the all-color mode in step S415, and the inclination of the position adjustment roller 20 is controlled so that a detected value Ps of the belt edge sensor 13 is stabilized at around a reference position. Subsequently, the above-described processes are repeated until it is determined that the process is completed in one of steps S412 and S416.

According to this embodiment, image formation can be always immediately started without a waiting time in a switched mode. Moreover, when belt control is executed in a monochromatic mode, an inclined position (as a target) of the steering roller 3 is fixed to the stable position defined in the all-color mode before switching the mode, and only a position adjustment roller 20 is controlled. Therefore, the belt control can be simplified. Further, because steering control is simply started targeting an inclined position (almost equal to a stable position in the last all-color mode) of the steering roller 3 defined right before switching of the mode to execute the belt control of the all-color mode, belt control can be again simplified and a new stable position can be immediately obtained.

Further, as described earlier in the second embodiment in which the image forming apparatus includes the monochromatic, four-color, and all-color modes, when the current mode is switched to the four-color mode, the steering roller 3 is fixed to the stable position NA defined in the last all-color mode, and only the position adjustment roller 21 may be controlled. In the same situation, when the current mode is switched to the monochromatic mode, the steering roller 3 is kept at an inclination position (NA) defined in the last all-color mode or the four-color mode as is, and only the position adjustment roller 20 and 21 may controlled.

In this way, when a current mode is switched to an image formation mode in which the number of transfer rollers contacting the intermediate transfer belt 1 decreases, a steering controller may fix the steering roller 3 at a previous inclination position defined before image formation modes are switched or a stable position of the inclination of the steering roller 3 defined in the image formation mode in which all of the multiple transfer rollers contact the intermediate transfer belt 1 (i.e., all-color mode), while the position adjuster may control the position adjustment roller 21 or position adjustment rollers 20 and 21 to adjust the position of the intermediate transfer belt 1 in its widthwise direction. Further, even after the current mode is switched to the all-color or four-color mode, image formation in a switched mode can be immediately started after it is switched without determining a difference from a value defined right before the switching of the modes or that from the stable position of the steering roller 3. Further, the belt control described above can be executed in parallel thereto.

Now, modifications of the above-described embodiments are described. In the above-described belt control in the monochromatic mode of the second embodiment shown in FIG. 15, the displacement of the intermediate transfer belt 1 is adjusted by controlling both the position adjustment rollers 20 and 21 in addition to steering control by the steering roller 3. However, it is preferable to separate the position adjustment roller 21 from the intermediate transfer belt 1 in the monochromatic mode and adjust the displacement of the intermediate transfer belt 1 only using the position adjustment roller 20.

The above-described embodiments relates to the image forming apparatus with four and five image formation units. However, the present invention can be applied to the other image forming apparatuses if equipped with (two or more) image formation units including multiple modes partially or entirely using these image formation units, and a stretching posture of a belt varies when the multiple modes are switched. A color of usage toner is not limited to yellow, magenta, cyan, and black, and the like. When four or more modes are included and a stretching posture of a belt varies per mode, three or more position adjustment rollers may be arranged.

Further, the above-described embodiments relate to the tandem type color image forming apparatus that employs an indirect transfer system with an intermediate transfer belt as a belt. However, the present invention is not limited to the above-described system and can be applied to a tandem type color image forming apparatus that employs a direct transfer system with a recording medium conveying belt instead of the intermediate transfer belt employed in the indirect transfer system. In such a situation, toner images of different colors formed on photoconductors of two or more image formation units, respectively, are directly transferred onto a recording medium (e.g. a sheet) transported by the recording medium conveying belt one after another. Therefore, multiple transfer rollers equivalent to primary transfer rollers employed in an indirect transfer system are provided in this situation. However, a secondary transfer roller can be omitted.

However, similar to the position adjustment rollers 20 and 21 employed in the above-described embodiment, the position adjustment roller is capable of adjusting a stretching posture of a belt while executing steering control targeting a stable position of a steering roller in a multicolor mode (e.g. an all-color mode and a four-color mode, and the like). When multiple stable positions of the steering roller in multicolor modes have been stored, the largest number mode, i.e. a mode using the largest number of the image formation units (the largest number of color modes represents an all-color mode) is preferably a target value for the steering roller.

According to one embodiment of the present invention of the above-described image formation apparatus, displacement of the belt caused in a widthwise direction when an image formation mode is switched can be quickly stabilized by the above-described steering controller and the belt position adjuster. Therefore, a high quality image can be promptly formed after switching of image formation modes without color displacement keeping a productivity of the image formation.

Numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus operable in multiple image formation modes, comprising:

a belt stretched and wound around a driving roller and multiple driven rollers;

multiple image formation units arranged in a running direction of the belt including photoconductors to form toner images of different colors on the photoconductors, respectively;

multiple transfer rollers opposed to a corresponding one of the photoconductors via the belt, respectively, the toner images on the photoconductors being successively transferred onto either the belt or a recording medium transported by the belt by the multiple transfer rollers, respectively;

an engagement/disengagement device to bring at least one of the multiple transfer rollers in contact with the belt and separate the at least one of the multiple transfer rollers therefrom in accordance with an image formation mode when the multiple image formation modes are switched;

a steering controller to correct displacement of the belt in its widthwise direction by inclining one of the multiple driven rollers in a prescribed direction as a steering roller not to change a perimeter of the belt at least in a first image formation mode in which all of the multiple transfer rollers contact the belt;

at least one position adjustment roller extending in the widthwise direction of the belt on the same side as the multiple transfer rollers at a region where a stretching posture of the belt varies when the multiple image formation modes are switched, the at least one position adjustment roller contacting the belt at a first given winding angle in a second image formation mode in which one of the multiple transfer rollers separates from the belt; and a belt position adjuster to adjust a position of the belt in its widthwise direction by inclining the at least one position adjustment roller in a prescribed direction not to change the perimeter of the belt in the second image formation mode.

2. The image forming apparatus as claimed in claim 1, further comprising:

a storage unit to store a stabilizing inclination of the steering roller, the stabilizing inclination stabilizing an intermediate transfer belt at a prescribed position in its widthwise direction under control of the steering controller in the first image formation mode, wherein the steering controller controls the position of the belt in its widthwise direction targeting the stabilizing inclination of the steering roller in the second image formation mode, and wherein the belt position adjuster adjusts the position of the belt in its widthwise direction by controlling the at least one position adjustment roller in the second image formation mode.

3. The image forming apparatus as claimed in claim 2, wherein when the second image formation mode is switched to the first image formation mode, and a difference between the stabilizing inclination of the steering roller stored in the storage unit and inclination of the steering roller defined right before switching of the image formation modes is equal to or less than a given value, image formation is immediately started in the first image formation mode, and wherein when the difference is not less than the given value nor equal to or less than the given value, image formation in the first image formation mode is started only when the position of the belt is stabilized in its widthwise direction by the steering controller or both the steering controller and the belt position adjuster.

4. The image forming apparatus as claimed in claim 1, wherein the steering controller fixes a target inclination of the steering roller to either an inclination defined immediately before switching of the image formation modes or a stabilizing inclination of the steering roller stored in the storage unit when the first image formation mode is switched to the second image formation mode.

5. The image forming apparatus as claimed in claim 1, wherein the at least one position adjustment roller contacts the belt at either no winding angle or a second given winding angle smaller than the first given winding angle in the second image formation mode.

6. The image forming apparatus as claimed in claim 5, wherein the multiple image formation modes include a third image formation mode in which fewer transfer rollers separate from the belt than in the second image formation mode, and wherein a pair of position-adjustment rollers are disposed and entirely or partially utilized corresponding to the image formation mode switched.

7. The image forming apparatus as claimed in claim 6, wherein one of the pair of position adjustment rollers only contacts the belt in one of the second and third image formation modes at the first given winding angle, and the other one of the pair of position adjustment rollers contacts the belt in both of the second and third image formation modes at the first given winding angle.

8. The image forming apparatus as claimed in claim 6, wherein the multiple image formation units forming toner images of different colors on respective photoconductors include:

a black image formation unit to form a black toner image;

at least three image formation units including at least three photoconductors to form at least three different toner images of yellow, magenta, and cyan, respectively; and a special color image formation unit to form a toner image of a special color, wherein the multiple transfer rollers include:

a black transfer roller opposed to a photoconductor included in the black image formation unit via the belt;

at least three transfer rollers opposed to the at least three photoconductors via the belt, respectively; and a special color transfer roller opposed to the photoconductor included in the special color image formation unit via the belt, wherein the first image formation mode is an all-color mode utilizing all of the multiple image formation units including the special color image formation unit, the second image formation mode is a monochromatic image formation mode only using the black image formation unit, and the third image formation mode is a four color mode utilizing the black and the at least three image formation units, wherein all of the multiple transfer rollers contact the belt in the all-color mode, only the special color transfer roller separates from the belt while only one of the pair of position adjustment rollers contacts the belt at the first given winding angle in the four-color mode, and the at least three transfer rollers and the special color transfer roller separate from the belt while both of the position adjustment rollers contact the belt at the first given winding angle in the monochromatic image formation mode.

9. The image forming apparatus as claimed in claim 1, wherein the at least one position adjustment roller separates from the belt in the second image formation mode.

10. The image forming apparatus as claimed in claim 1, wherein the multiple image formation units include:

a black image formation unit to form a black toner image; and at least three image formation units including at least three photoconductors to form at least three different toner images of yellow, magenta, and cyan colors, respectively, wherein the multiple transfer rollers include:

a black transfer roller opposed to the photoconductor included in the black image formation unit via the belt; and at least three transfer rollers opposed to the at least three photoconductors via the belt, respectively, wherein the first image formation mode is an all-color mode utilizing all of the multiple image formation units, and the second image formation mode is a monochromatic mode only using the black image formation unit, wherein all of the multiple transfer rollers contact the belt in the all-color mode, and the at least three transfer rollers separate from the belt while the at least one position adjustment roller contacts the belt at the first given winding angle in the monochromatic mode.

11. A method of forming an image in an image forming apparatus that includes a belt stretched and wound around a driving roller and multiple driven rollers, multiple image formation units arranged in a running direction of the belt including photoconductors to form toner images of different colors on the photoconductors, respectively, multiple transfer rollers facing corresponding one of the photoconductors via the belt, respectively, and at least one position adjustment roller arranged in the widthwise direction of the belt on the same side as the multiple transfer rollers at a region where a stretching posture of the belt varies when multiple image formation modes are switched, the method comprising:

successively transferring the toner images from the photoconductors to either the belt or a recording medium transported by the belt by the multiple transfer rollers, respectively;

bringing at least one of the multiple transfer rollers with an engagement/disengagement device in contact with the belt or separating the at least one of the multiple transfer rollers therefrom in accordance with an image formation mode when the multiple image formation modes are switched;

bringing the at least one position adjustment roller in contact with the belt at a first given winding angle in a second image formation mode in which one of the multiple transfer rollers separates from the belt;

correcting displacement of the belt in its widthwise direction under control of a steering controller by inclining one of the multiple driven rollers in a prescribed direction as a steering roller not to change a perimeter of the belt at least in a first image formation mode in which all of the multiple transfer rollers contact the belt; and adjusting a position of the belt in the widthwise direction with a belt position adjuster by inclining the at least one position adjustment roller in a prescribed direction not to change the perimeter of the belt in the second image formation mode.

12. The method as claimed in claim 11, further comprising:

storing a stabilizing inclination of the steering roller in a storage unit, the stabilizing inclination stabilizing an intermediate transfer belt at a prescribed position in its widthwise direction under control of the steering controller in the first image formation mode;

controlling the position of the belt in its widthwise direction under control of the steering controller while targeting the stabilizing inclination of the steering roller in the second image formation mode; and adjusting the position of the belt in its widthwise direction under control of the belt position adjuster by controlling the at least one position adjustment roller in the second image formation mode.

13. The method as claimed in claim 12, further comprising:

immediately starting the image formation in the first image formation mode when switched from the second image formation mode, and a difference between the stabilizing inclination of the steering roller stored in the storage unit and inclination of the steering roller defined right before switching of the image formation modes is equal to or less than a given value; and starting the image formation in the first image formation mode only when the difference is not less than the given value but the position of the belt is stabilized in its widthwise direction under control of either the steering controller or both the steering controller and the belt position adjuster.

14. The method as claimed in claim 11, further comprising fixing a target inclination of the steering roller under control of the steering controller to either an inclination defined immediately before switching of the image formation modes or a stabilizing inclination of the steering roller stored in the storage unit when the first image formation mode is switched to the second image formation mode.

15. The method as claimed in claim 11, further comprising bringing the at least one position adjustment roller in contact with the belt at either no winding angle or a second given winding angle smaller than the first given winding angle in the second image formation mode.

16. The method as claimed in claim 15, further comprising:

switching between the multiple image formation modes to and from a third image formation mode in which fewer transfer rollers separate from the belt than in the second image formation mode;

arranging a pair of position-adjustment rollers; and entirely or partially operating the pair of position-adjustment rollers corresponding to the image formation mode switched.

17. The method as claimed in claim 16, further comprising:

bringing only one of the pair of position adjustment rollers in contact with the belt in one of the second and third image formation modes at the first given winding angle; and bringing the other one of the pair of position adjustment rollers in contact with the belt in both the second and third image formation modes at the first given winding angle.

18. The method as claimed in claim 16, wherein said image forming apparatus includes a black image formation unit to form a black toner image in the multiple image formation units forming toner images of different colors on respective photoconductors, at least three image formation units including at least three photoconductors to form at least three different toner images of yellow, magenta, and cyan, respectively, in the multiple image formation units, a special color image formation unit to form a toner image of a special color, a black transfer roller opposed to the photoconductor included in the black image formation unit via the belt, at least three transfer rollers opposed to the at least three photoconductors included in at least three image formation units via the belt, respectively, a special color transfer roller opposed to the photoconductor included in the special color image formation unit via the belt, the method further comprising:

bringing all of the multiple transfer rollers in contact with the belt in an all-color mode when the first image formation mode is an all-color mode utilizing all of the multiple image formation units including the special color image formation unit;

separating only the special color transfer roller from the belt while bringing only one of the pair of position adjustment rollers in contact with the belt at the first given winding angle in a four-color mode when the third image formation mode is a four color mode utilizing the black and the at least three image formation units; and separating the at least three transfer rollers and the special color transfer roller from the belt while bringing both of the position adjustment rollers in contact with the belt at the first given winding angle in a monochromatic mode when the second image formation mode is a monochromatic image formation mode only using the black image formation unit.

19. The method as claimed in claim 11, further comprising separating the at least one position adjustment roller from the belt in the second image formation mode.

20. The method as claimed in claim 11, wherein said image forming apparatus includes a black image formation unit in the multiple image formation units to form a black toner image, at least three image formation units including at least three photoconductors in the multiple image formation units to form at least three different toner images of yellow, magenta, and cyan colors, respectively, a black transfer roller opposed to the photoconductor included in the black image formation unit via the belt, and at least three transfer rollers opposed to the at least three photoconductors included in the at least three image formation units via the belt, respectively, the method further comprising:

bringing all of the multiple transfer rollers in contact with the belt in an all-color mode when the first image formation mode is the all-color mode utilizing all of the multiple image formation units; and separating the at least three transfer rollers from the belt while the at least one position adjustment roller contacts the belt at the first given winding angle when the second image formation mode is a monochromatic mode only using the black image formation unit.

* * * * *